US010085558B2

(12) United States Patent
Klaus

(10) Patent No.: US 10,085,558 B2
(45) Date of Patent: Oct. 2, 2018

(54) PULL-OUT GUIDE FOR A DRAWER, AND METHOD FOR SECURING A DRAWER TO A PULL-OUT GUIDE

(71) Applicant: PAUL HETTICH GMBH & CO. KG, Kirchlengern (DE)

(72) Inventor: Stefan Klaus, Bunde (DE)

(73) Assignee: PAUL HETTICH GMBH & CO. KG, Kirchlengern (DE)

( * ) Notice: Subject to any disclaimer, the term of this patent is extended or adjusted under 35 U.S.C. 154(b) by 1 day.

(21) Appl. No.: 15/128,774

(22) PCT Filed: Mar. 25, 2015

(86) PCT No.: PCT/EP2015/056422
§ 371 (c)(1),
(2) Date: Sep. 23, 2016

(87) PCT Pub. No.: WO2015/144769
PCT Pub. Date: Oct. 1, 2015

(65) Prior Publication Data

US 2017/0105525 A1 Apr. 20, 2017

(30) Foreign Application Priority Data

Mar. 25, 2014 (DE) ..... 10 2014 104 136

(51) Int. Cl.
*A47B 88/00* (2017.01)
*A47B 88/427* (2017.01)
*A47B 88/49* (2017.01)

(52) U.S. Cl.
CPC ..... *A47B 88/427* (2017.01); *A47B 88/49* (2017.01); *A47B 2088/4272* (2017.01);
(Continued)

(58) Field of Classification Search
CPC ..... A47B 88/427; A47B 2088/4272; A47B 2088/4274; A47B 2088/4278
(Continued)

(56) References Cited

U.S. PATENT DOCUMENTS 7,014,282 B2 * 3/2006 Hammerle ..... A47B 88/407 312/330.1
8,585,165 B2 * 11/2013 Liang ..... A47B 88/427 312/334.4

(Continued)

FOREIGN PATENT DOCUMENTS

DE 28 39 011 3/1980
DE 93 14 893 U1 2/1994

(Continued)

OTHER PUBLICATIONS

Search Report issued in International App. No. PCT/EP2015/056422 (dated 2015).

(Continued)

*Primary Examiner* — Matthew W Ing
(74) *Attorney, Agent, or Firm* — Barnes & Thornburg LLP

(57) ABSTRACT

A pull-out guide for a drawer, comprising a guide rail can be fixed to a body and a running rail which is movably mounted. At least one central rail can optionally be provided between the guide rail and the running rail, and a securing device with a holder is provided on the running rail, wherein a drawer can be fixed to the holder. The holder is mounted in a movable manner in the longitudinal direction of the running rail and is pretensioned towards the front in the pull-out direction by means of an energy accumulator. In this manner, a drawer can be easily mounted on the securing device, and manufacturing tolerances can be compensated for.

21 Claims, 23 Drawing Sheets

(52) U.S. Cl.
CPC ..... *A47B 2088/4274* (2017.01); *A47B 2088/4278* (2017.01); *A47B 2210/0054* (2013.01); *A47B 2210/0056* (2013.01)

(58) Field of Classification Search
USPC ..... 312/334.4, 334.5, 334.6, 334.27
See application file for complete search history.

(56) References Cited

U.S. PATENT DOCUMENTS

| | | | | |
|---|---|---|---|---|
| 8,777,340 | B2 * | 7/2014 | Greussing | A47B 88/427 312/334.4 |
| 8,870,313 | B2 * | 10/2014 | Grabherr | A47B 88/427 312/334.5 |
| 9,066,587 | B1 * | 6/2015 | Liang | A47B 88/0422 |
| 2003/0234603 | A1 * | 12/2003 | Salice | A47B 88/407 312/334.5 |
| 2009/0167128 | A1 * | 7/2009 | Berger | A47B 88/427 312/334.4 |
| 2009/0212679 | A1 * | 8/2009 | Frousiakis | A47B 88/427 312/334.1 |
| 2012/0319548 | A1 * | 12/2012 | Netzer | A47B 88/0422 312/334.1 |

FOREIGN PATENT DOCUMENTS

| | | |
|---|---|---|
| DE | 20 2008 011114 U1 | 1/2010 |
| DE | 10 2013 104829 | 11/2014 |
| EP | 1147725 | 10/2001 |
| EP | 2182788 | 5/2010 |
| WO | WO 2010/020496 | 2/2010 |

OTHER PUBLICATIONS

Search Report issued in German App. No. 10 2014 104 136.4 (dated 2015).

* cited by examiner

PULL-OUT GUIDE FOR A DRAWER, AND METHOD FOR SECURING A DRAWER TO A PULL-OUT GUIDE

CROSS-REFERENCE TO RELATED APPLICATIONS

This application is a U.S. nationalization under 35 U.S.C. § 371 of International Application No. PCT/EP2015/056422, filed Mar. 25, 2015, which claims priority to German Patent Application No. 10 2014 104 136.4, filed Mar. 25, 2014. The disclosures set forth in the referenced applications are incorporated herein by reference in their entireties.

BACKGROUND AND SUMMARY OF THE DISCLOSURE

The present disclosure relates to a pullout guide for a drawer, having a guide rail fixable on a body and a movably mounted slide rail, wherein optionally at least one middle rail can be provided between the guide rail and the slide rail, and a securing device having a holder is provided on the slide rail, on which a drawer is fixable, and a method for securing a drawer to a pullout guide.

EP 1 147 725 discloses a pullout guide for drawers, in which a vertically-adjustable holding lug is provided on a slide rail, which is insertable into an opening on the drawer to adjust the inclination of the front panel. The vertical adjustment does enable a certain flexibility, but manufacturing tolerances can also occur in the longitudinal direction of the slide rail, so that the fixing of the drawer between the holding lug and a further securing means on the slide rail can be complex. Reworking can then be required for the fixation of the drawer. In an unfavorable case, the holding lug only still engages with a small component of its length in the drawer, so that in the event of a tilting torque, which can arise during the opening or closing of a drawer, the force introduction into the holding lug can result in deformation or failure.

A pullout guide is proposed in WO 2010/020496, in which a catch hook for securing the drawer on the slide rail is arranged on the slide rail. The catch hook is formed in this case as a separate element, which is fixed on the slide rail, wherein a spring element can be provided between the catch hook and the drawer to support the drawer rear wall in a springy manner on the catch hook. A certain tolerance compensation is thus possible, however, the catch hook remains rigidly fixed on the slide rail. The force introduction into the catch hook is also disadvantageous here, since the catch hook can also have a certain distance to the drawer rear wall because of tolerances and therefore, in the disadvantageous case, only engage with a small component of its length in the drawer.

The present disclosure provides a pullout guide for a drawer, which enables a simple installation of a drawer, and additionally can compensate for length tolerances and/or a depth adjustment of the drawer. Furthermore, a method for securing a drawer to a pullout guide is provided.

According to the disclosure, a securing device having a holder is provided on the slide rail, on which a drawer is fixable, wherein the holder is mounted so it is displaceable in the longitudinal direction of the slide rail and is pre-tensioned via a force accumulator toward the front in the longitudinal direction of the pullout guide. If a drawer is installed on the slide rail, the holder is displaced against the force of the force accumulator toward the rear side of a furniture body, so that manufacturing tolerances of the drawer, the guide rail, or the slide rail can be compensated for. In addition, tolerances in components of the securing device should not adversely affect the installation. Due to the displaceable mounting of the holder, a depth adjustment in the longitudinal direction of the slide rail can also be performed in a simple manner, because the holder is displaceably mounted in any case, so that the drawer is fixed so it is adjustable on the holder in this direction by a suitable adjustment device. In addition, the drawer can be held in a substantially friction-locked manner on the slide rail by the pre-tensioning of the holder, so that interfering play is avoided. Furthermore, the installation is made easier by the displacement of the holder, because the user feels during the installation whether the drawer was correctly engaged with the holder and displaced.

For a simple installation of the securing device, a guide can be provided for the holder, which is mounted laterally on the slide rail. The structural height is thus not disadvantageously influenced by the securing device. The guide can be formed in an additional component or also integrally with the slide rail.

For a compact structure, the displaceable holder can have an upper projection, which is insertable into a receptacle or a holding device on a rear wall of the drawer, and a lower guide section, which is movable along a guide. The holder thus has an essentially U-shaped structure and can be produced as a bent metal plate or plastic part.

For fixing the drawer, further securing means in addition to the displaceable holder can be provided on the slide rail, so that the drawer can be secured, in particular, latched to the slide rail, and locked against rail. In this case, the installation of the drawer on the holder can be performed without tools, which facilitates the removal and placement of the drawers.

The holder may be pre-tensioned by a spring, which is tensioned between a housing of the securing device and the holder. The spring can be designed in this case as a traction or compression spring, in particular as a coiled spring. Instead of the spring, other types of force accumulators, for example, elastic and/or compressible elements made of elastomeric material or rubber can also be used. The spring can be arranged approximately parallel in the longitudinal direction of the pullout guide in this case, however, it can also be arranged inclined in relation to the longitudinal direction of the pullout guide and/or in relation to the horizontal, whereby, in addition to the main action direction in parallel to the longitudinal direction of the pullout guide, one or more force components are also additionally able to draw or press the holder in at least one further direction perpendicular to the pullout direction.

In one embodiment, the holder is adjustable in a horizontal direction perpendicular to the longitudinal direction of the slide rail. The positioning of the drawer in the horizontal direction can thus be set by the holder. For this purpose, for example, the guide having the holder can be mounted so it is pivotable on a housing of the securing device. Alternatively, an adjustment eccentric, a curve guide, or another mechanism can be provided to adjust the holder in the horizontal direction perpendicular to the longitudinal direction of the slide rail.

In a further embodiment, the holder and/or drawer is also vertically adjustable in relation to the slide rail. For this purpose, a support for the drawer, the holder, and/or the holding device on the rear wall of the drawer can enable a corresponding vertical adjustment. The position of the drawer in relation to the slide rail is changed by the vertical adjustment, wherein an inclination adjustment on the front panel can also be performed by the vertical adjustment.

According to a further embodiment, the holder is displaceable along a guide, which is aligned inclined in relation to the horizontal. This embodiment enables a clamping fixation of the drawer on the slide rail or a component connected thereto, wherein the guide preferably slopes downward toward the rear and thus clamping forces can be applied to the drawer perpendicularly in relation to the longitudinal direction of the slide rail during the displacement of the holder. This enables particularly stable and play-free fixation of the drawer.

According to a further embodiment variant, the drawer has a recess on the bottom in the middle region, the opening is therefore not located on the rear wall, but rather on a wall of the recess.

According to a further embodiment variant, the holder extends laterally inward toward the drawer center. The holder having its projection and its "lower guide portion" is tilted in this case by 90° toward the drawer center. Instead of an opening in the rear wall on the drawer, for example, an angled plate is then arranged on the drawer bottom, which contains an opening. The holder is coupled to the drawer in this case via the angled plate.

The pullout guide according to the disclosure is used in particular in items of furniture or domestic appliances, to fix a drawer between two pullout guides.

The term drawer is understood in this case to also include all types of pullout elements which are displaced by means of pullout guides, for example, pullout shelves or wire baskets.

Figure 1:
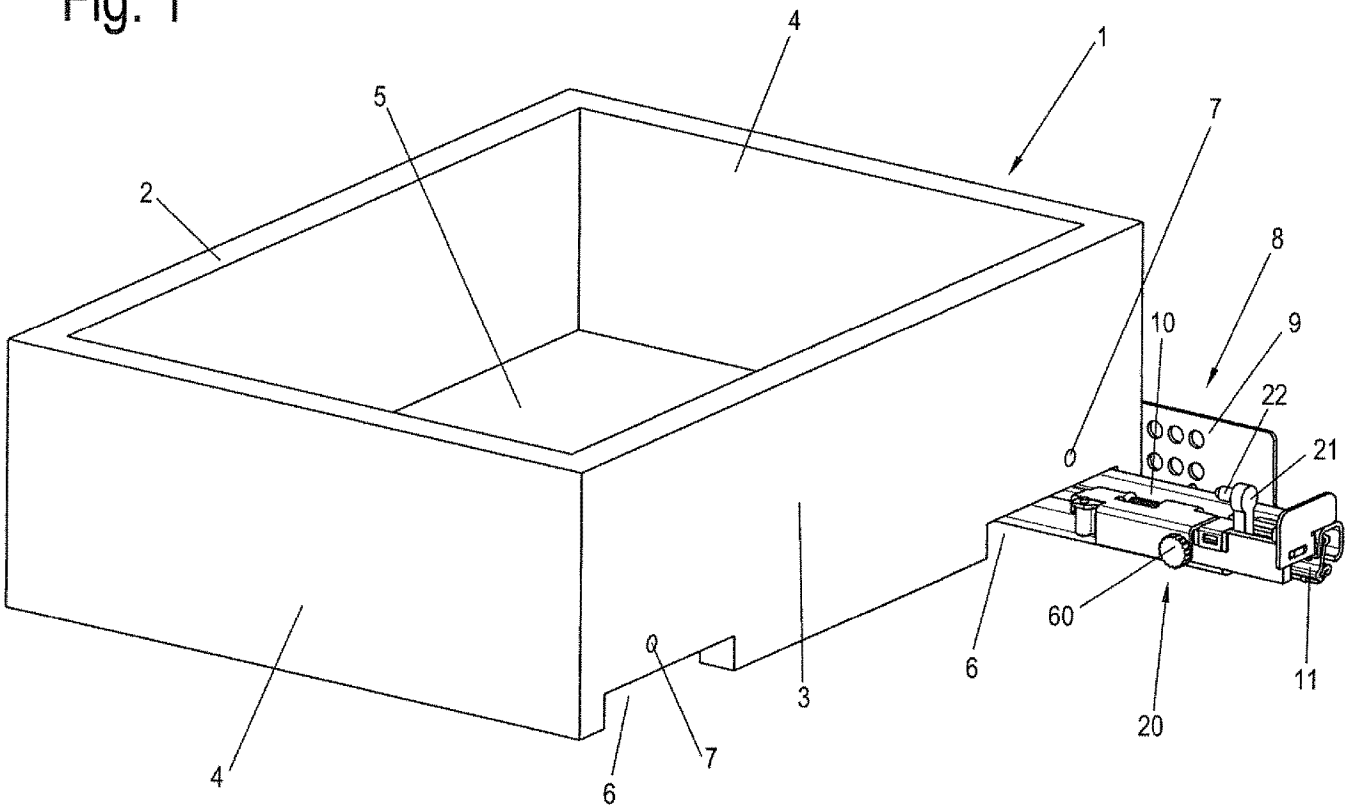
FIG. 1 shows a perspective view of a drawer having a pullout guide according to the disclosure during the installation.

A drawer 1 comprises a front panel 2, a rear wall 3, and side walls 4, which connect front panel 2 and rear wall 3 to one another. Furthermore, a bottom 5 is provided, wherein front panel 2, rear wall 3, side walls 4, and bottom 5 can be produced from wood, metal, or another material.

Two recesses 6 are provided on the rear wall 3, on each of which one pullout guide 8 is installed. Furthermore, an opening 7 is provided in the rear wall 3 above the recess 6, in which a projection 22 of a holder 21 is insertable to fix the drawer 1 on a slide rail 10 of the pullout guide 8. The pullout guide 8 can be designed as a full pullout and can comprise a guide rail 9, which is fixable on a body, and a middle rail 11, on which the slide rail 10 is mounted so it is movable. Furthermore, a securing device 20, on which the holder 21 is mounted so it is displaceable, is fixed on the slide rail 10 in the rear region.

Figures 2A, 2B:
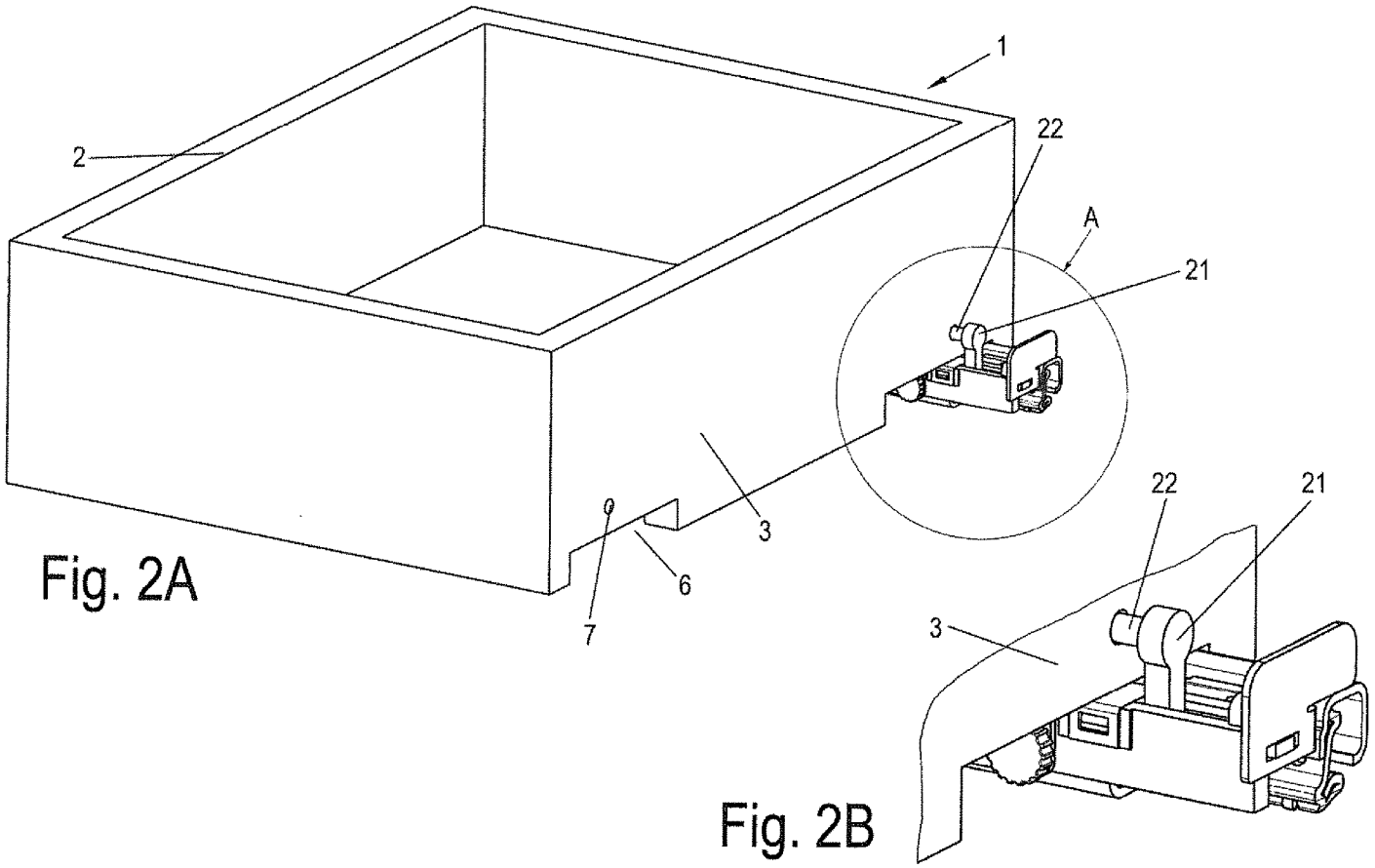
FIGS. 2A and 2B show two views of the pullout guide and the drawer of FIG. 1 during the installation.

For the installation, the drawer 1 is placed with the bottom 5 on the two slide rails 10 on opposing sides and then displaced to the rear until the projection 22 on the holder 21 engages in the opening 7, as shown in FIGS. 2A and 2B. When the projection 22 has penetrated completely into the opening 7, a vertical leg of the holder 21 or a corresponding attachment comes into contact with the drawer rear wall 3. The holder is thus coupled to the drawer 1 and moves together with the drawer during the further displacement of the drawer 1 in the direction of its installation end position. In this case, the distance between the holder and the drawer rear wall does not change, or only changes insignificantly, for example, because of a height change of the drawer support.

The drawer 1 is displaced to the rear against the force of a spring or another force accumulator, which pre-tensions the holder 21 toward the front side against a front stop on a cover 62. The drawer 1 can then be fixed via a securing means (not shown in greater detail) on the slide rail 10, for example, by latching. Such devices for securing a drawer on the slide rail are known, for example, from DE 10 2013 104 829 and can be provided with a depth adjustment for the drawer. The drawer has therefore reached its installation end position.

Figure 3:
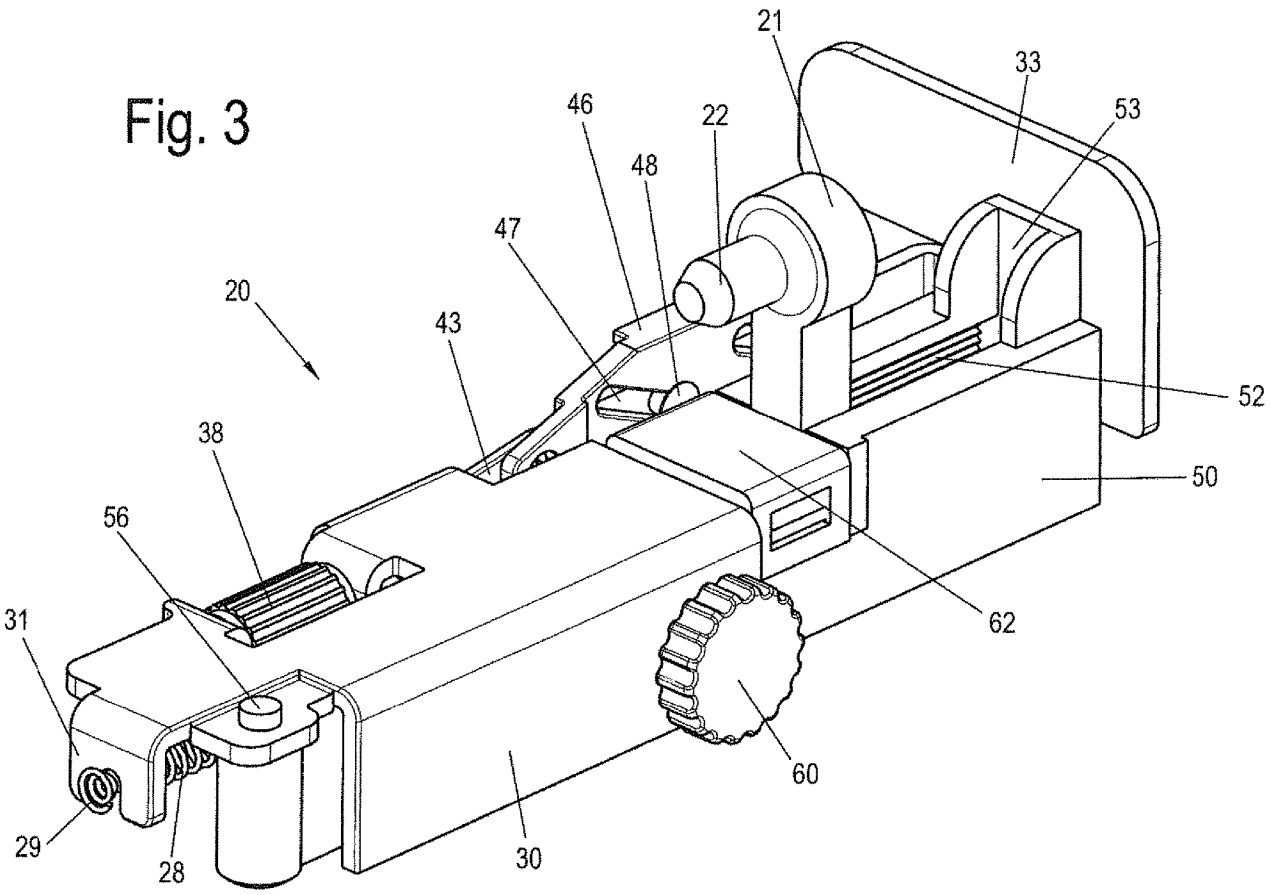
FIG. 3 shows a perspective view of the securing device of the pullout guide of FIG. 1.
Figure 4:
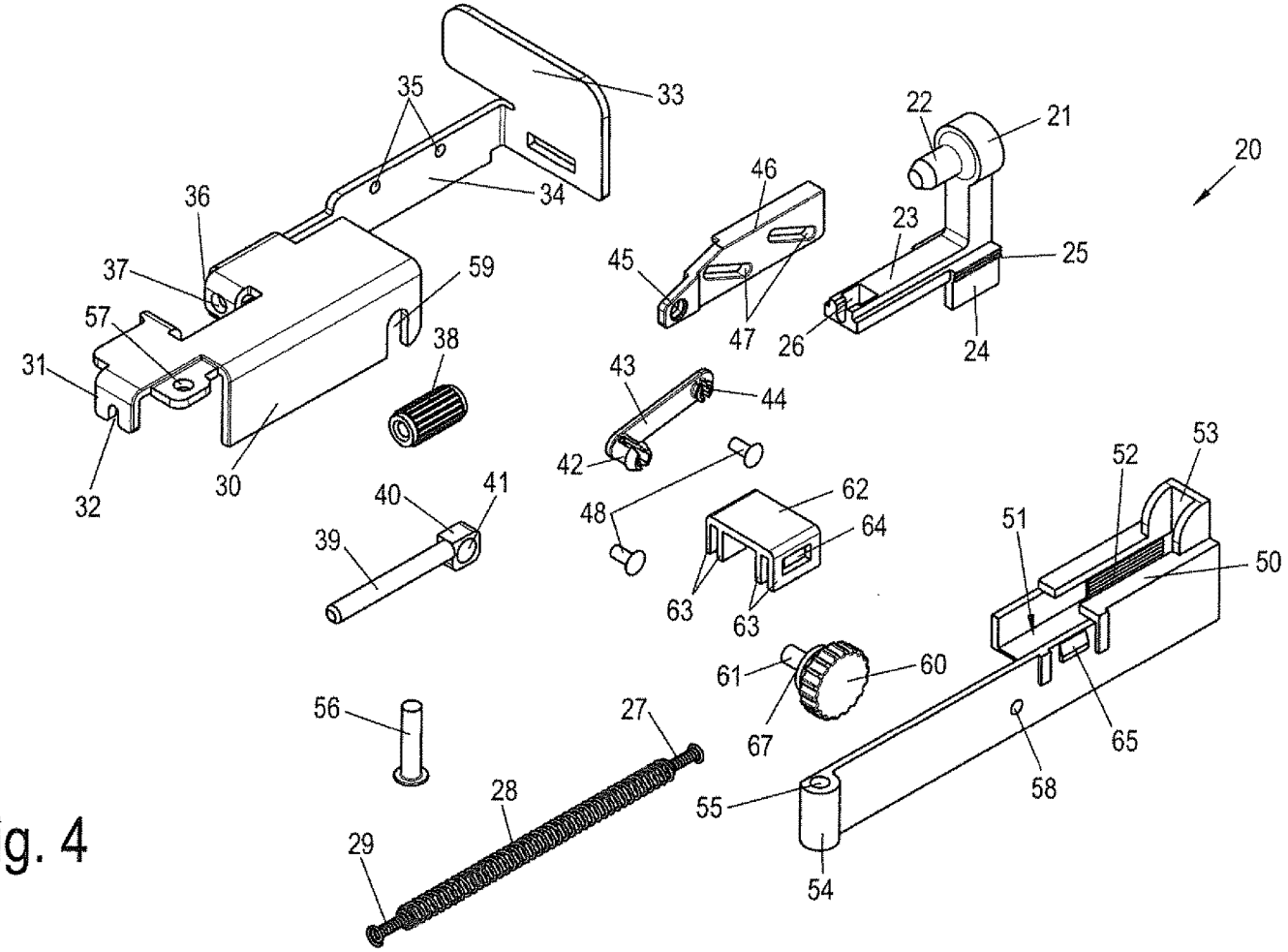
FIG. 4 shows a perspective exploded illustration of the securing device of FIG. 3.

The securing device 20 is shown in detail in FIGS. 3 and 4.

The securing device 20 comprises, in the upper region, a pin-shaped projection 22, which is aligned toward the front side, and a web 23 arranged underneath, which is displaceable linearly along a guide 50. The displacement travel is delimited to the rear by a rear wall 53 on the guide 50 and to the front by a cover 62, which is latched on the guide 50. The guide 50 forms a groove 51, on the side walls of which inwardly protruding teeth 52 are provided, which are engaged with teeth 25 of the holder 21 when the holder 21 has been displaced to the rear in the guide 50. No teeth 52 are provided on the side walls of the groove 51 in the front region of the guide 50.

The holder 21 is pre-tensioned in the opening direction by a force accumulator in the form of a spring 28, which is designed as a coiled spring. One end 27 of the spring 28 is fixed on a receptacle 26 of the holder 21 on the web 23. An opposing end 29 of the spring 28 is held on an angled portion 31 of a housing 30 of the securing device 20, wherein a receptacle 32 for inserting the end 29 is provided for this purpose on the portion 31. Alternatively, the opposing end 29 of the spring 28 can also be held indirectly or directly on the slide rail, for example, on an angled part formed integrally from the slide rail.

A particularly advantageous effect is that, due to the pre-tensioning of the holder in relation to the drawer, an improved force action on the projection 22 of the holder 21 results in relation to the prior art. If a fully loaded drawer is pulled out, and/or in the event of incorrect operations, it tilts about its horizontal transverse axis, whereby the projection 22 of the holder 21 is loaded from bottom to top as a lift-off safeguard. A lift-off force F attempts to bend the projection 22 upward. The force F acts on the outer edge of the rear wall 3. If a distance of x mm exists between the rear wall and the vertical leg of the holder 21, a bending torque of F*x thus acts on the holder. The distance dimension x is dependent in this case on the length tolerances of the furniture and guide components, and on the length of the depth adjustment, and can be several millimeters.

Because the hook 21 is always pressed by spring force against the drawer rear wall, the distance dimension x is set entirely or nearly to zero millimeters, and almost no bending torque acts on the projection.

The securing device 20 is designed so that an adjustment of the drawer 1 is possible both vertically and also in the lateral direction. In addition, a depth adjustment in parallel to the longitudinal direction of the slide rail 10 is possible.

For a vertical adjustment, a slide 46 is provided on the housing 30, which has oblong holes 47 aligned inclined in relation to the horizontal. Pins 48, which are fixed on openings 35 of a web 34 of the housing 30, are arranged in the oblong holes 47. A rear wall 33 is provided at the end of the web 34. To adjust the slide 46 vertically, a knurled nut 38 having an internal thread is located on the housing 30, which is mounted between two bent-over tabs 36 so it is stationary in the axial direction, but is rotatable on the bearings 37. A threaded bolt 39 is arranged in the knurled nut 38, which is rotationally fixed but axially displaceable. The threaded bolt 39 is connected in this case to a block 40 having a lever 43, wherein a bendable bearing pin 42 is provided on the lever 43, which can be latched on an opening 41 of the block 40. On the opposing side, the lever 43 is latched via a bendable bearing pin 44 in an opening 45 on the slide 46. If the knurled nut 38 is rotated, the threaded bolt 39 moves in the axial direction and pulls or pushes the lever 43 accordingly, to move the slide 46. The slide 46 is moved diagonally in relation to the horizontal via the guide of the two oblong holes 47 on the pins 48 and an upper support surface of the slide 46 is thus moved upward or downward in relation to the housing 30 and the slide rail 10. Since the drawer 1 is supported with the bottom 5 or the side wall 4 on the support surface of the slide 46, the vertical position of the drawer 1 in relation to the slide rail 10 is thus set.

During the installation, the drawer is moved toward the projection 22 on the holder 21. The holder 21 for accommodating the drawer 1 on the slide rail 10 is pre-tensioned by a spring, more or less in a maintenance position at a front stop. The vertical location of the holder 21 is predefined in this case.

The drawer is then placed on the slide rail 10, and the holder 21 is first pushed together with the drawer into its final end position. This end position can vary depending on tolerances. Nonetheless, the connection of the holder 21 to the drawer may be secure in every end position due to the spring force. Independently of the length tolerances of the components and the adjustment travel of a depth adjustment, it is therefore ensured that the projection (22, 82, 122) plunges, in the case of installed drawer, with at least 80% of its length into the drawer (1) and/or into a holding device (70) on the rear wall (3) of the drawer (1).

The vertical adjustment of the slide 46 is independent of the projection 22 and the holder 21. Adjustment is generally performed with pulled-out drawer. It can be seen in FIG. 1 that the knurled wheel is not reachable with partially inserted drawer.

For the vertical adjustment, the drawer 1 is detached from the front securing device on the slide rail 10 and pulled downward to the front over a distance of approximately 10 cm from the holder/the slide rail, still resting partially on the slide rail.

One now has access to the knurled nut 38. The slide 46 can then be vertically adjusted via the knurled nut 38. The drawer 1 is then moved to the rear again until the opening 7 strikes against the holder 21. If the projection 22 is inserted completely into the opening 7, the holder 21 moves against the spring force together with the drawer. The drawer then strikes with its bottom on the inclined intake ramp of the slide 46 and runs up along the incline to the other vertical level. In this case, the holder 21 is carried along (also vertically). During the further travel, the teeth 25 of the holder engage in the teeth 52 of the guide 50 and therefore prevent lifting off of the drawer upward.

The vertical adjustment is thus not performed with an installed drawer in this exemplary embodiment, but rather with an at least partially uninstalled drawer.

The securing device 20 furthermore enables a lateral setting of the position of the drawer 1. For this purpose, the guide 50 is mounted so it is pivotable on the housing 30. The guide 50 is designed as a lever, on one end 54 of which a bearing sleeve 55 is provided, which is penetrated by a vertical bearing pin 56. The vertical bearing pin 56 is furthermore mounted so it is rotatable on a bearing opening 57 on the housing 30. In a middle region of the guide 50, a threaded opening 58 is formed on a web, into which a threaded bolt 61 of a screw 60 is screwed. The screw 60 comprises a gap between a ring 67 and a screw head, at which a wall of the housing 30 is inserted adjacent to a slot 59, so that the screw 60 is held so it is non-displaceable on the housing 30 in the axial direction. If the screw 60 is rotated, the distance between the wall of the housing 30 with the slot 59 and the guide 50 changes. The guide 50 thus pivots about the bearing pin 56, whereby the position of the holder 21 changes in a horizontal direction perpendicular to the longitudinal direction of the slide rail 10.

When the drawer 1 is removed, the holder 21 is to be prevented from being removed from the guide 50. Therefore, a cover 62, which is latched on the guide 50, is provided on the guide 50 in the front region. The cover 62 is formed essentially U-shaped, wherein two webs 63 are provided on both legs of the U, of which one web has an opening 64. When the cover 62 is plugged onto the two webs of the guide 50, a catch projection 65 on one web enters the opening 64 and therefore prevents unintentional uninstallation of the cover 62. The holder 21 can therefore only be pushed during a removal of the drawer 1 up to the cover 62, which is used as a stop and prevents the holder 21 from being able to be removed upward and uninstalled.

Figure 5:
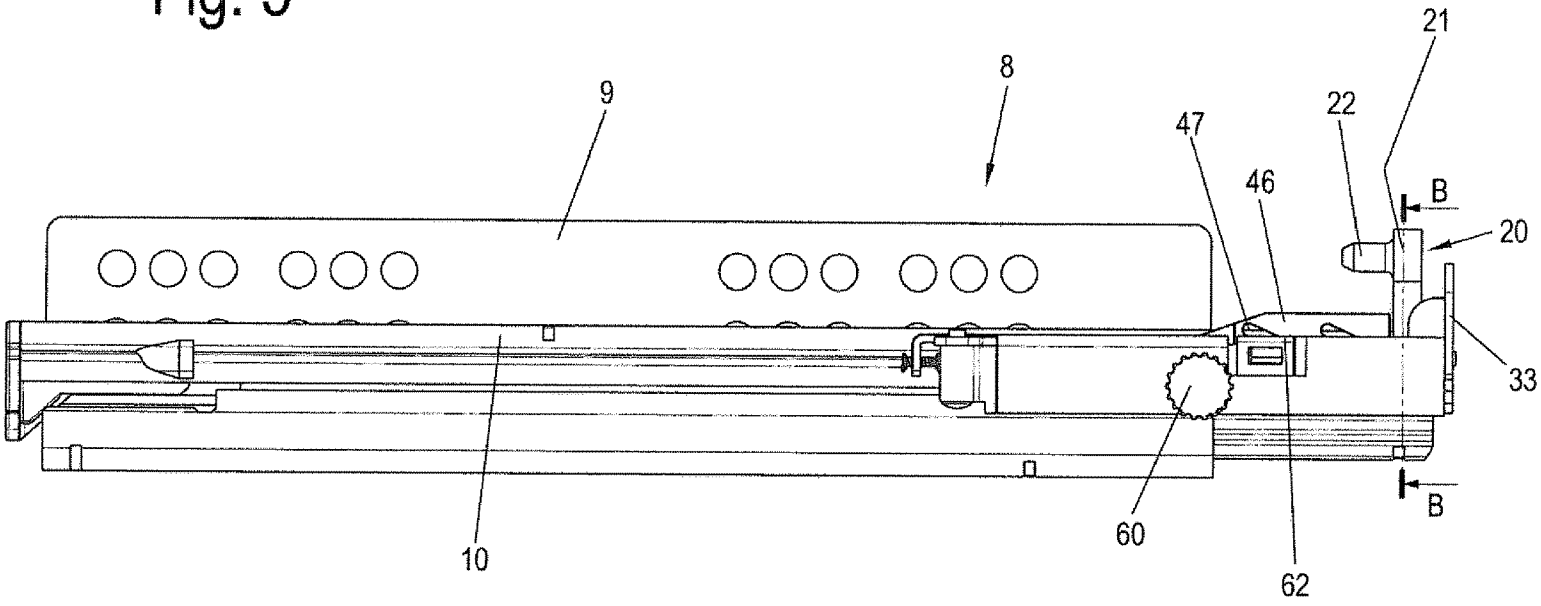
FIGS. 5 to 9 show multiple views of the pullout guide of FIG. 1, partially in section.

In FIG. 5, the securing device 20 is installed on the pullout guide 8. As can be seen in the sectional view of FIG. 6, with installed drawer, the teeth 25 on the holder 21 are engaged with the teeth 52 on the guide 50. A linear displacement of the holder 21 on the guide 50 is thus enabled, but raising or lowering is not. In addition, the guide 50 is pivotable within the housing 30 to a certain extent about the bearing pin 56, so that a lateral adjustment of the holder 21 can also be performed. If the pullout guide 8 is located in the extended position, the adjustment procedures can be performed by hand without tools, because the screw 60 and the knurled nut 38 are externally accessible. This enables a convenient setting of the position of the drawer 1.

Figure 6:
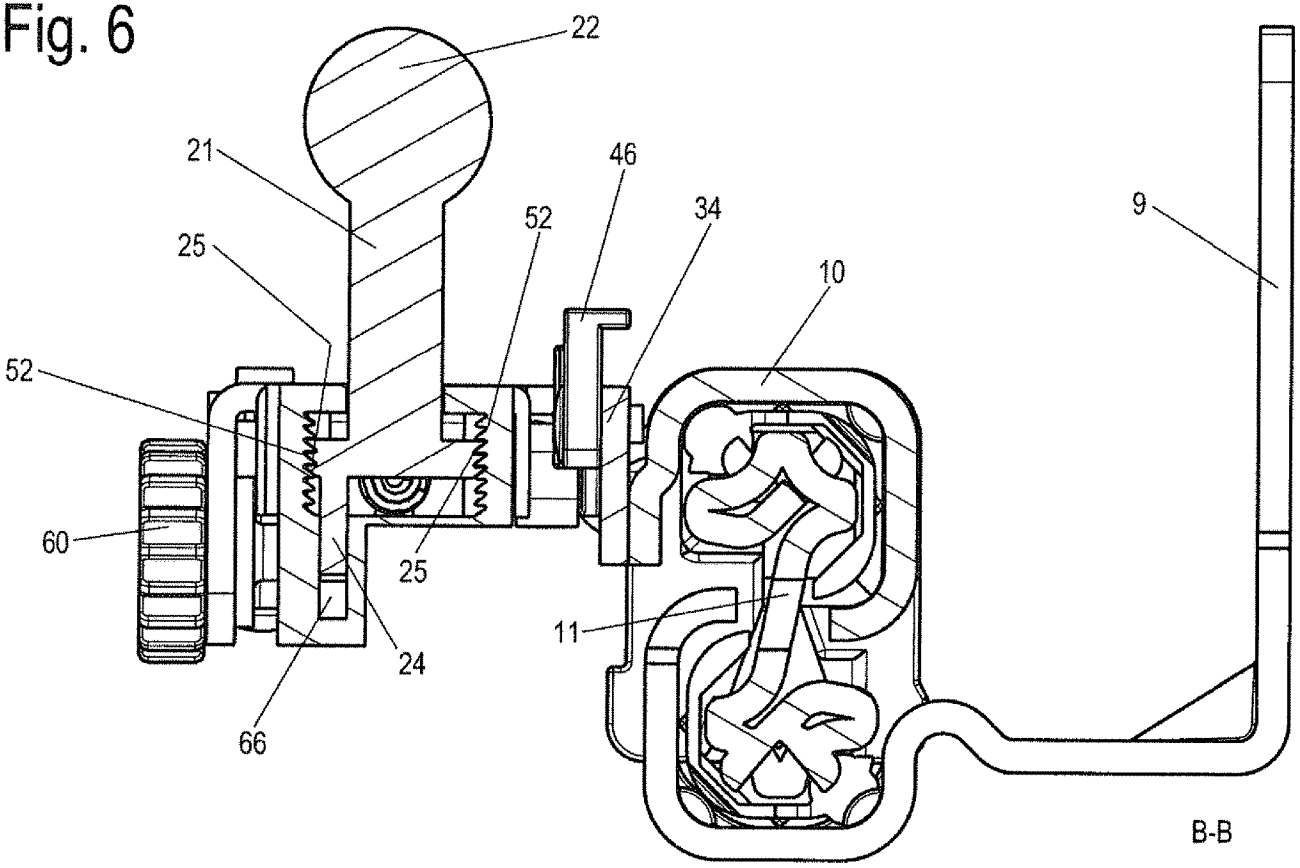
Figure 7:
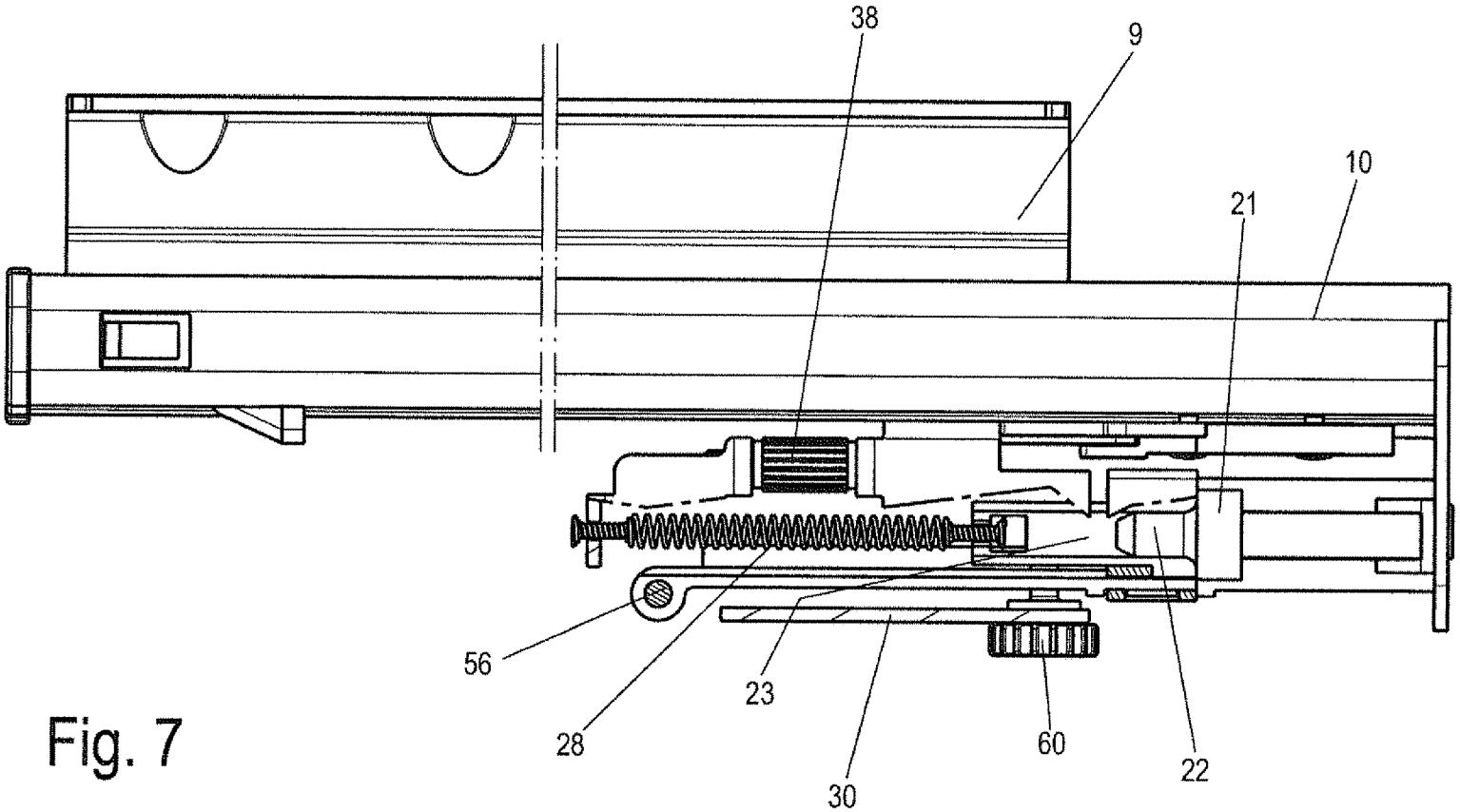

As shown in FIG. 6, a web 24 protruding vertically downward on the holder 21 is guided in a groove 66 of the guide 50 for good guiding in the longitudinal direction.

Figure 8:
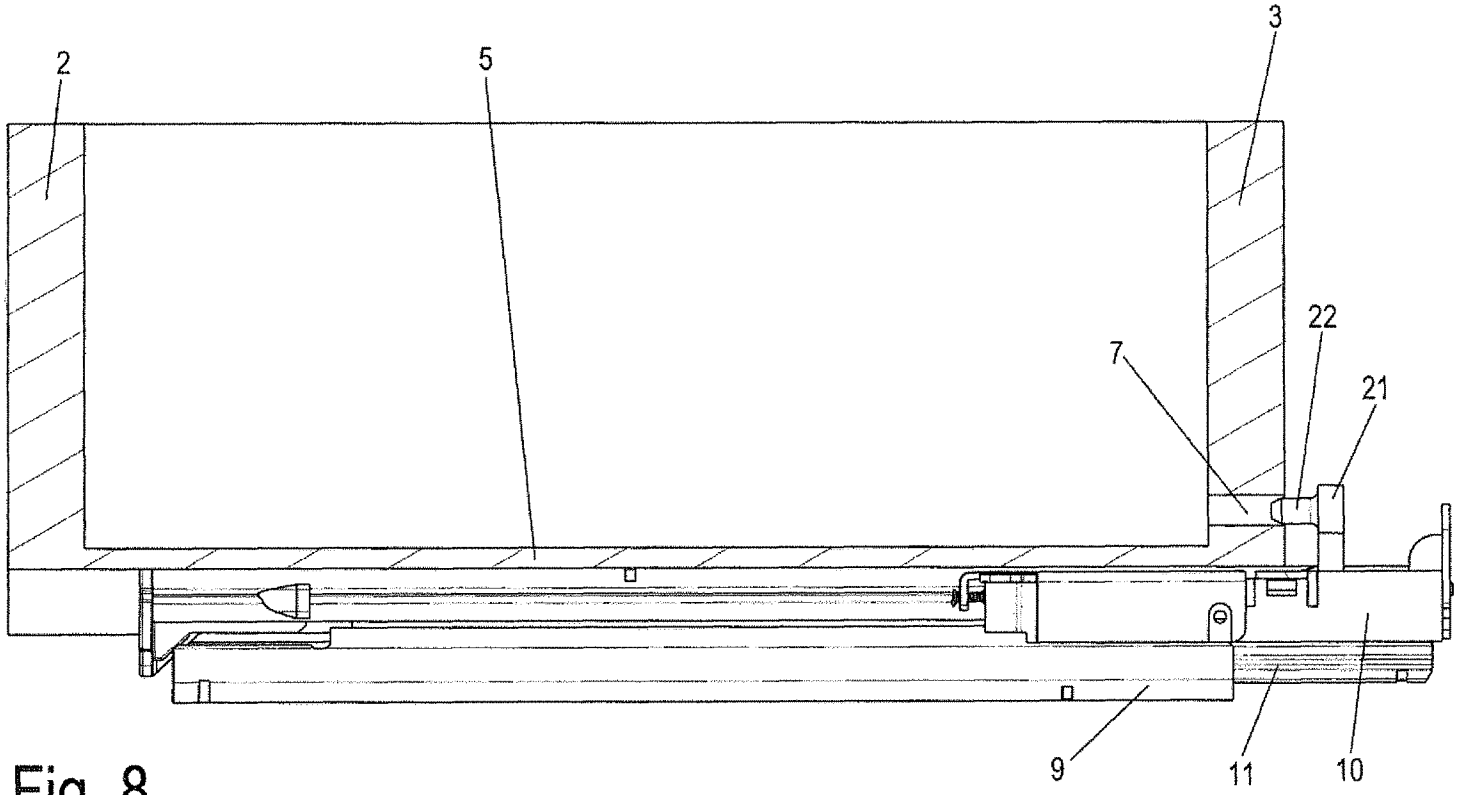
Figure 9:
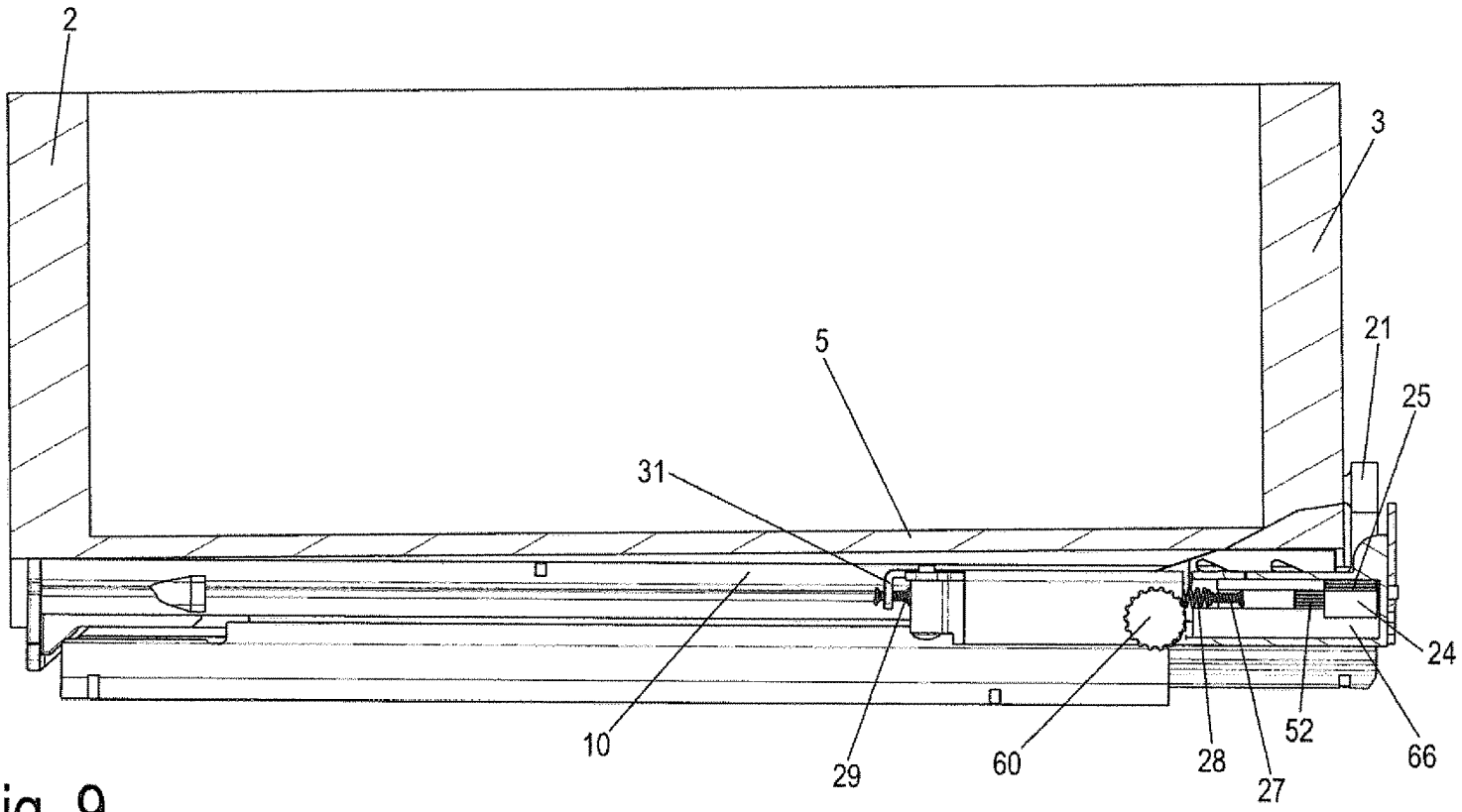

The drawer 1 is shown during installation in FIG. 8, in which the projection 22 is inserted into the opening 7 on the rear wall 3. The drawer 1 is now pushed further to the rear until the rear wall 3 displaces the holder 21 to the rear, as shown in FIG. 9. The spring 28 is thus tensioned further, until the desired end position is reached. For this purpose, the holder 21 can be moved up to the rear wall 53 on the guide 50, but a position of the rear wall 53 can also be used as the end position.

Figure 10:
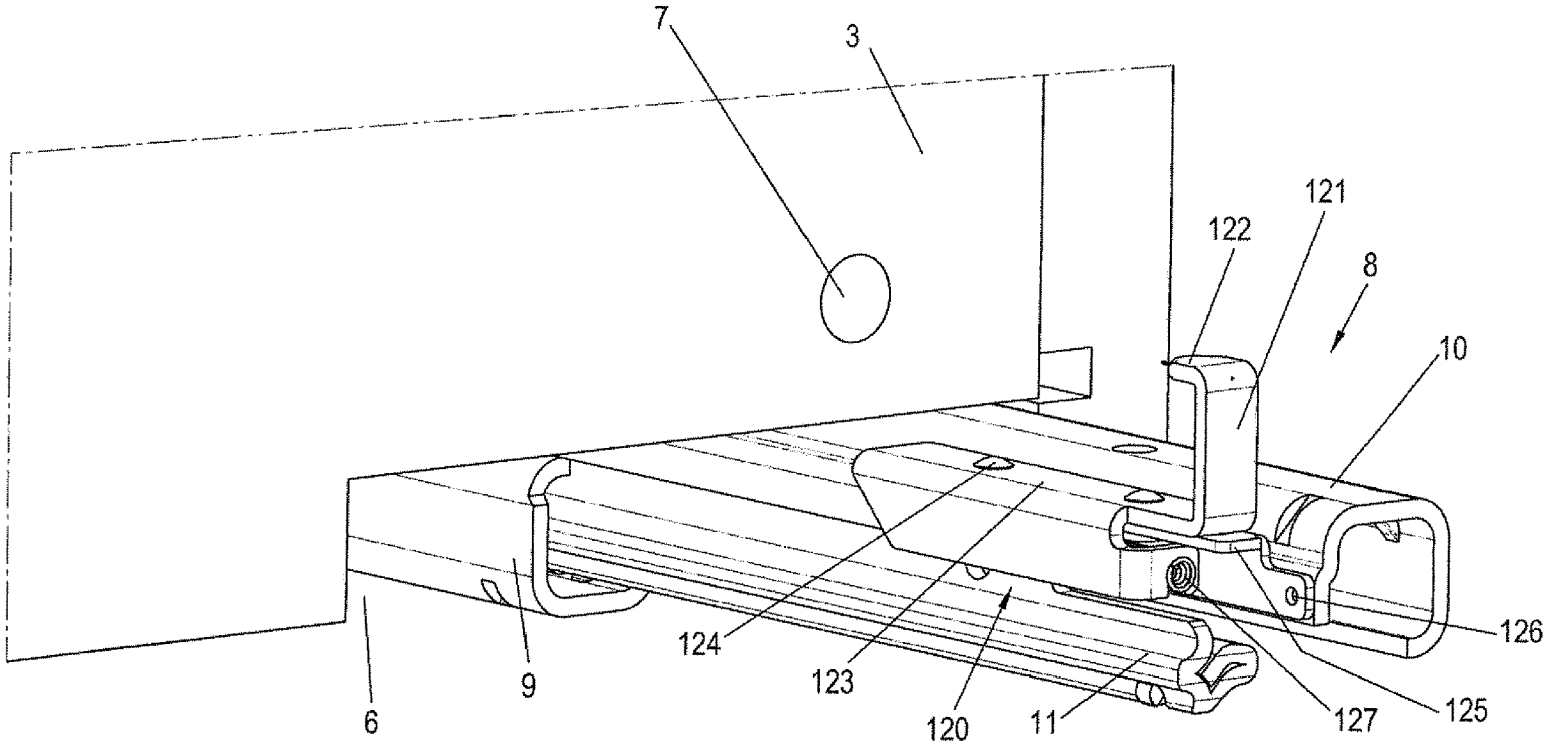
FIGS. 10 and 11 show two perspective views of a modified securing device for a pullout guide.
Figure 11:
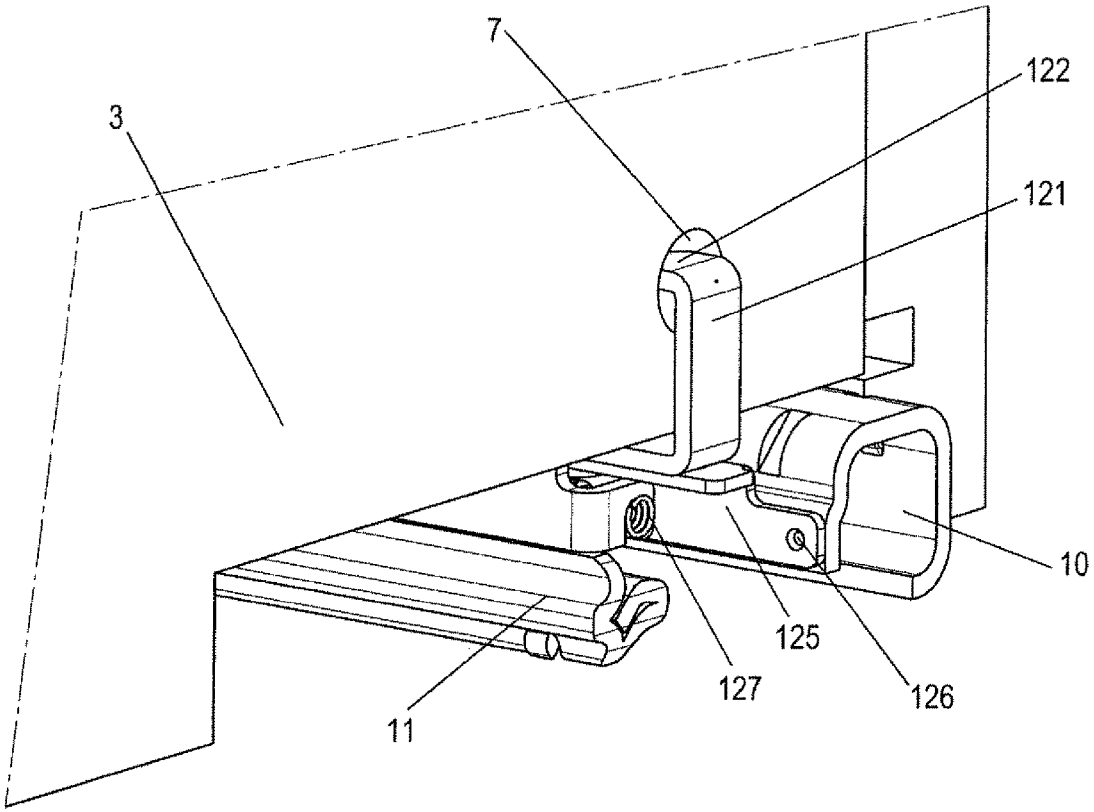

FIGS. 10 and 11 show a modified exemplary embodiment of a securing device 120 for a pullout guide 8, which is used for fixing a drawer 1. In this and the following exemplary embodiments, the same reference signs are used for the same components, so that only the modified components are described in detail.

The securing device 120 comprises a holder 121 made of a bent metal plate, which has a projection 122 oriented toward the front side, which is insertable into an opening 7 of the rear wall 3 of the drawer 1. The holder 121 has a substantially C-shaped contour, wherein a web 123 is formed spaced apart from the upper projection 122, which is mounted so it is displaceable via guide elements, in particular bolts 124. For this purpose, on a guide 125, which can be produced from a bent metal plate, a guide is formed in the form of oblong holes, in which the bolts 124 on the web 123 engage. The guide 125 is fixed via a securing means 126, in particular spot welds or adhesive spots, on the slide rail 10. Furthermore, a spring 127 is provided, which is tensioned between the holder 121 and the guide 125, so that the holder 121 is pre-tensioned in the opening direction. The holder 121 is only linearly displaceable in this case, so that the further adjustment functions, such as the lateral adjustment and the vertical adjustment, are omitted. The securing device 120 can thus be produced and installed in a simple manner using only a few components.

For installation, the drawer is moved with the rear wall 3 toward the securing device 120, to then insert the projection 122 into the opening 7 and displace the holder 121 against the force of the spring 127, as shown in FIG. 11. After the latching or fixation on further securing means of the slide rail 10, the drawer 1 is securely held, wherein a length compensation can be performed if needed via the holder 121.

Figure 12:
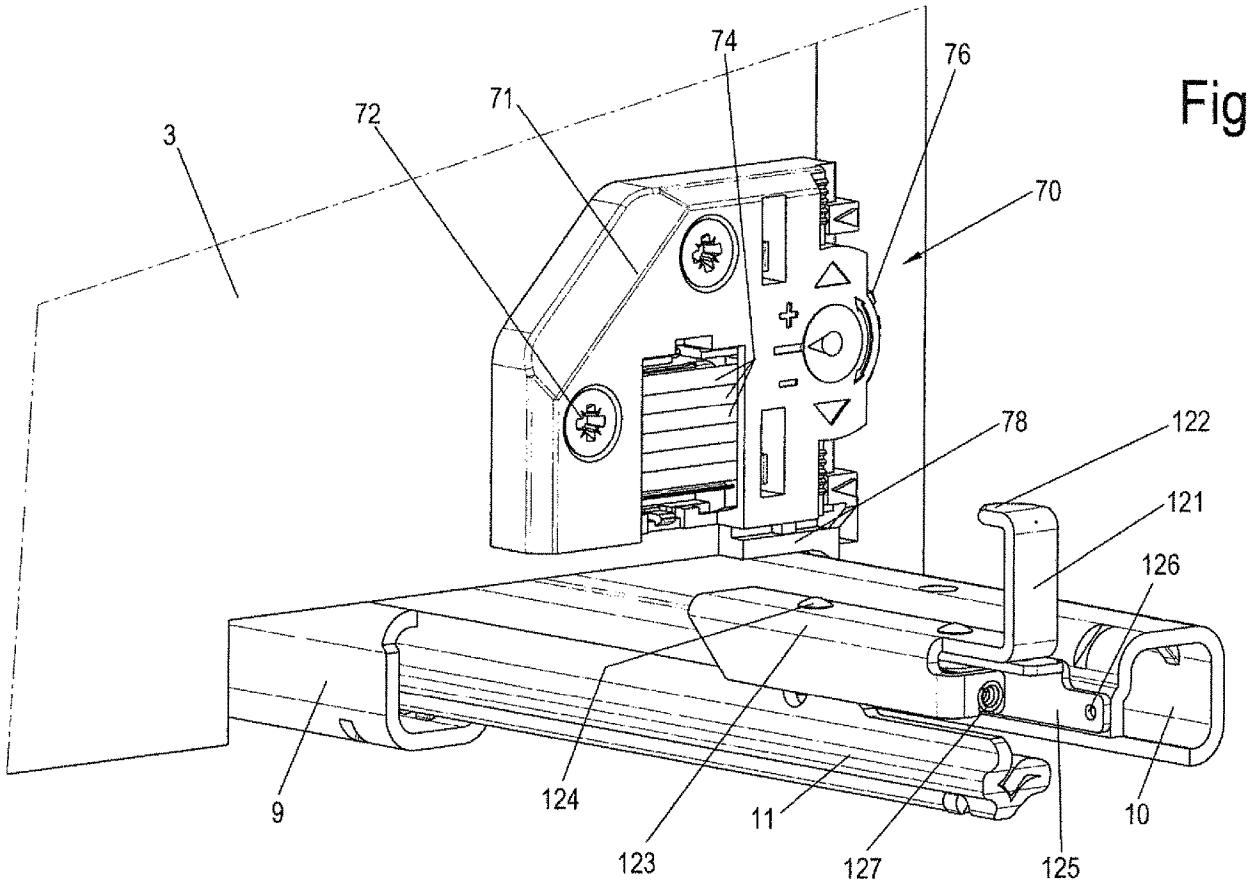
FIGS. 12 and 13 show a modified exemplary embodiment of a securing device for a pullout guide.
Figure 13:
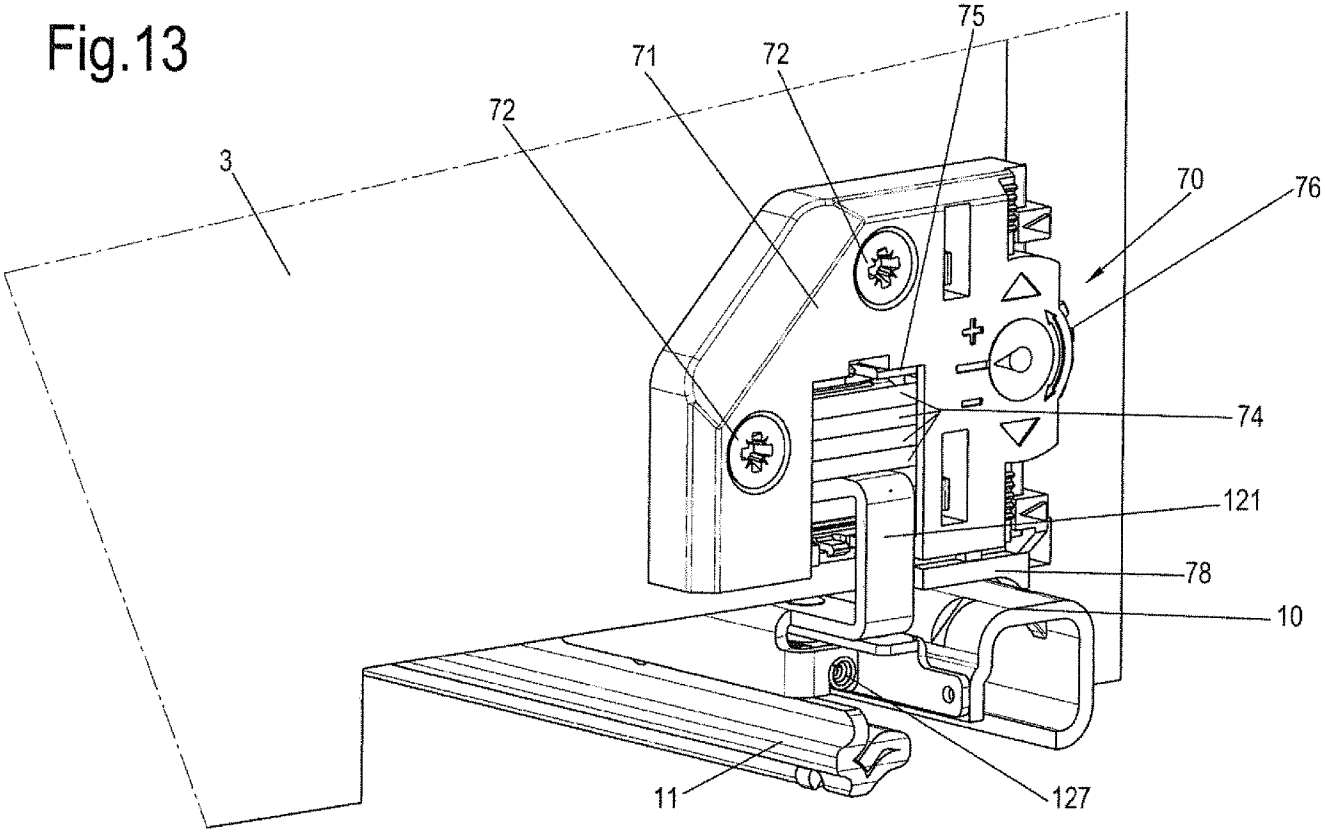
Figure 14:
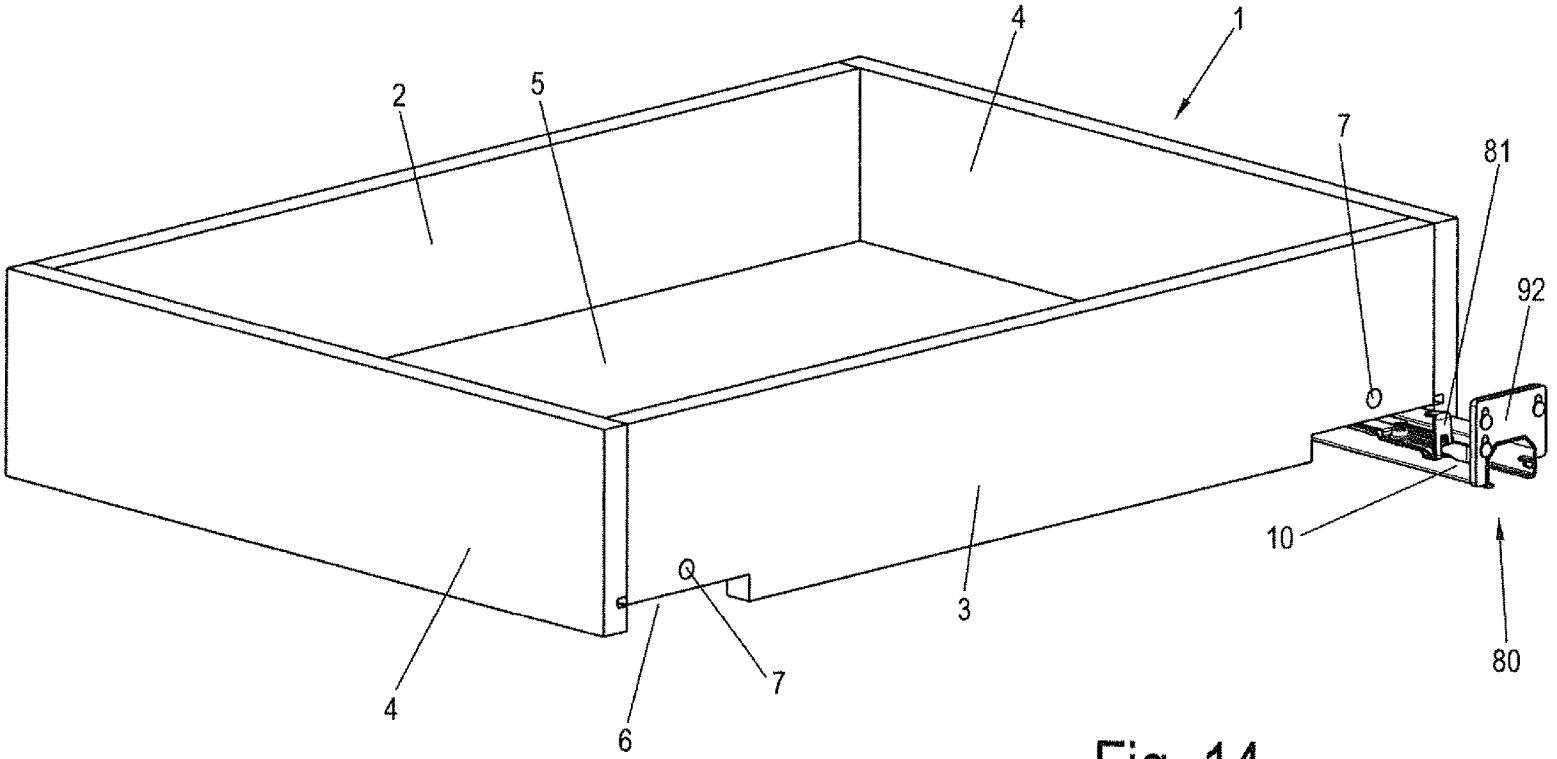
FIGS. 14 to 21B show views of a further exemplary embodiment of a pullout guide for a drawer.
Figure 15:
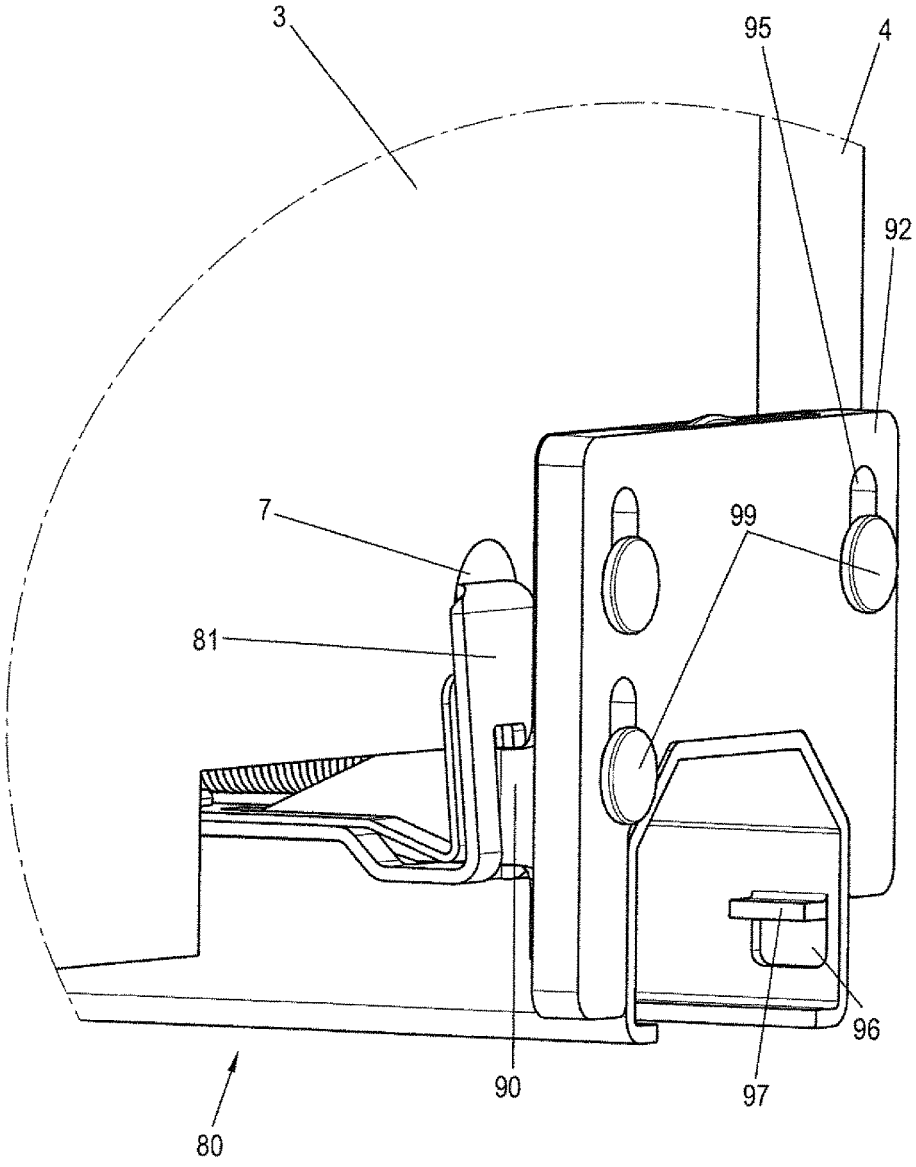

FIGS. 12 and 13 show an exemplary embodiment modified from the exemplary embodiment of FIGS. 10 and 11, in which the holder 121 is as described above, but a holding device 70 is provided on the rear wall 3 of the drawer, by means of which a vertical adjustment of the drawer 1 can be performed in the region of the rear wall 3. The holding device 70 comprises a housing 71, which is fixed via multiple screws 72 on the rear wall 3. Multiple rod-shaped support elements 74 are stacked one over another in a laminar manner on a recess of the housing 71, wherein the projection 122 is inserted into the stack of support elements 74 for the fixation, so that the drawer is secured against lifting off.

Furthermore, an adjustment mechanism having a rotatable wheel 76 is provided on the housing 71, which is mounted so it is rotatable on the housing 71 and can move a support element 78 vertically, wherein a toothed rack is provided for this purpose, for example. The height of the rear wall 3 in relation to the slide rail 10 can thus be adjusted by rotating the wheel 76. After the desired height of the rear wall 3 is set by the wheel 76, the drawer 1 can be moved toward the holder 121, so that the projection 122 plunges between two support elements 74, to fix the drawer 1 on the holding device 70. The support elements 70 can be accommodated with slight play inside the housing 71, so as not to obstruct the plunging in of the projection 122. The drawer 1 having the rear wall 3 can thus be fixed in the desired vertical position on the holding device 70.

FIGS. 14 to 21B show a further embodiment of a securing device 80, which is used for the fixation of a drawer 1 on a slide rail 10. The securing device 80 comprises a displaceable holder 81, which is insertable into an opening 7 on the rear wall 3 of the drawer 1, to fix it at opposing sides on a slide rail 10. The securing device 80 is shown in the installed position in FIG. 15.

Figure 16A:
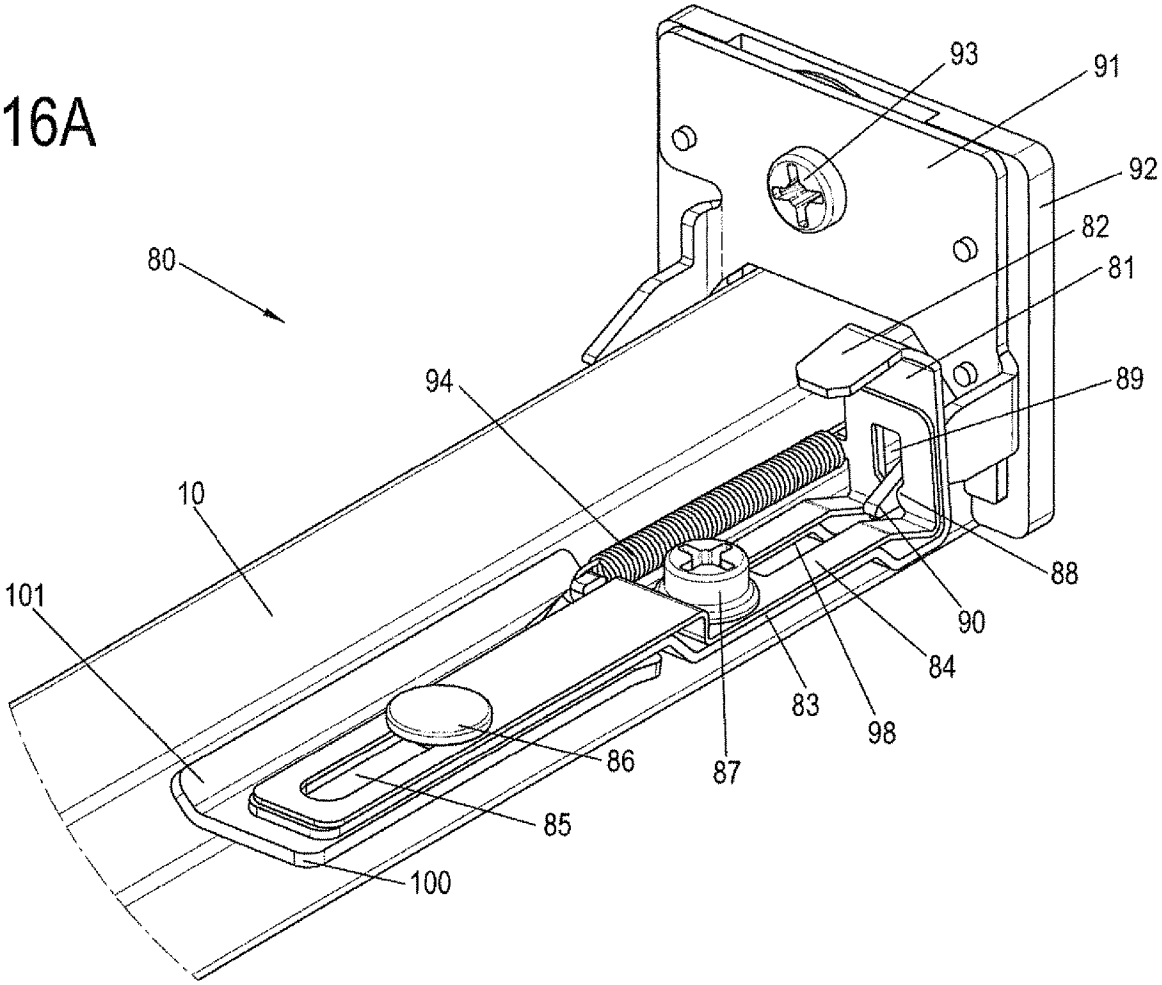
Figure 16B:
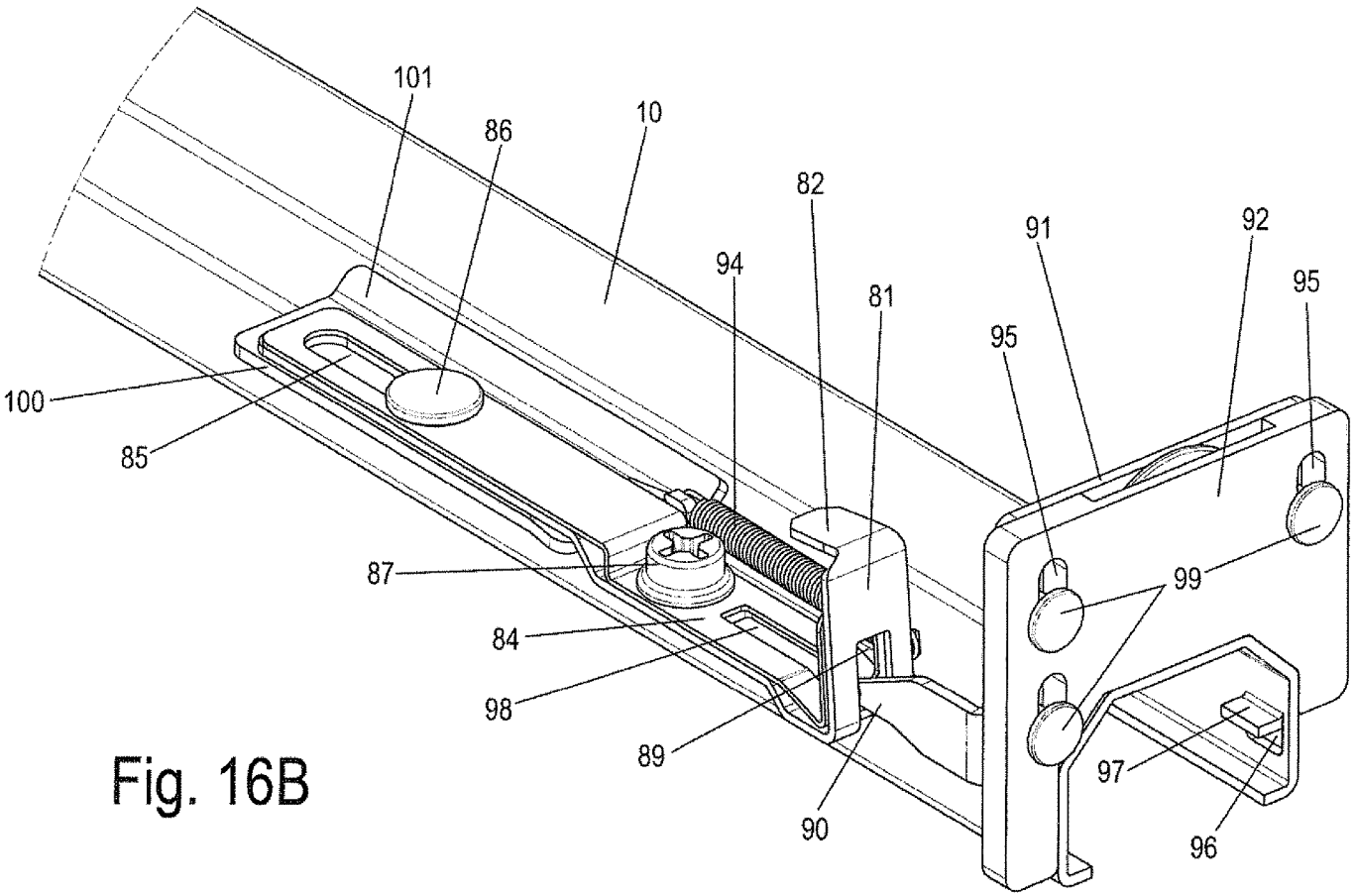

FIGS. 16A and B show the securing device without drawer 1, and it is recognizable that the holder 81 has a projection 82 pointing in the opening direction, which is insertable into the opening 7. The holder 81 is designed as substantially C-shaped and comprises a lower web 83, which is mounted so it is displaceable on a holding web 100. The holding web 100 is fixed using a portion 101 on the slide rail 10, for example, by welding or gluing. An upwardly protruding pin 86 having a widened head portion is fixed on the holding web 100, which penetrates an oblong hole 85 in the lower web 84 of the holder 81. The holder 81 is thus mounted so it is displaceable on the holding web 100. A spring 94 is tensioned between the holding web 100 and the holder 81, which is designed as a traction spring and is held at one on the holding web 100 fixed on the slide rail 10 and at the opposite side on a projection of the holder 81.

The holder 81 can furthermore be adjusted in a direction horizontal and perpendicular in relation to the longitudinal direction of the slide rail 10. For this purpose, an upper web 84 is provided on the lower web 83, which regionally rests on the web 83 and is also guided so it is displaceable on the pin 86 and the holding web 100 and has an oblong hole 85. In a region adjacent to the spring 94, an eccentric 87 is provided, by means of which the upper web 84 can be pivoted in relation to the lower web 83 about the pin 86. The upper web 84 is held in this case by a lug 90, which fixes the upper web 84 in the lateral direction. For this purpose, a slotted recess 98 is provided in each case on a vertical portion of the upper web 84 and the lower web 83, having a vertical portion 89, through which a tip of the lug 90 is guided. Inwardly oriented projections 88 are provided on the upper web 84 in the region of the lug 90, so that the upper web is not displaceable in the lateral direction. If the eccentric 87 is adjusted, the upper web 84 can be held by the lug 90, while the lower web 83 is pivoted laterally with the holder 81.

Furthermore, a vertical adjustment unit is provided for the lug 90, which is formed integrally with a vertical plate 91. The vertical plate 91 is held so it is displaceable on a support plate 92, wherein the support plate 92 is fixedly connected to the slide rail 10. The slide rail 10 has a recess 96 on a side wall, in which a web 97 of the support plate 92 engages. Furthermore, the support plate 92 encompasses the outer contour of the slide rail 10, so that slide rail 10 and support plate 92 form a fixed unit. The support plate is preferably welded onto the slide rail 10. Multiple vertical oblong holes 95 are left out on the support plate 92, which are penetrated by pins 99, which are fixed on the plate 91. Furthermore, an eccentric 93 is fixed on the plate 91, which is mounted so it is rotatable and displaces the plate 91 in the vertical direction in relation to the support plate 92 during a rotational movement, whereby the lug 90 is lifted or lowered. Alternatively to the eccentric 93, a flat threaded spindle can also be used.

Figure 17A:
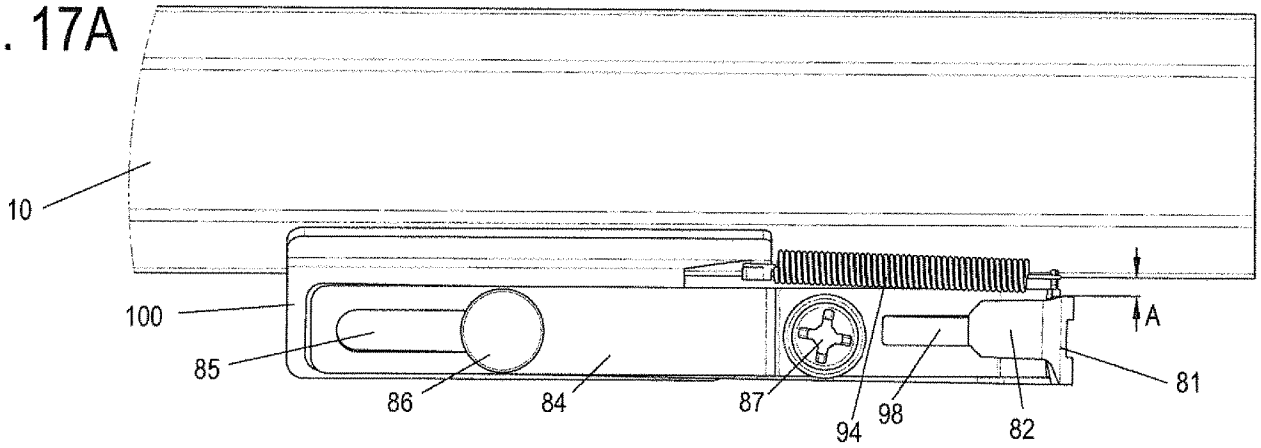
Figure 17B:
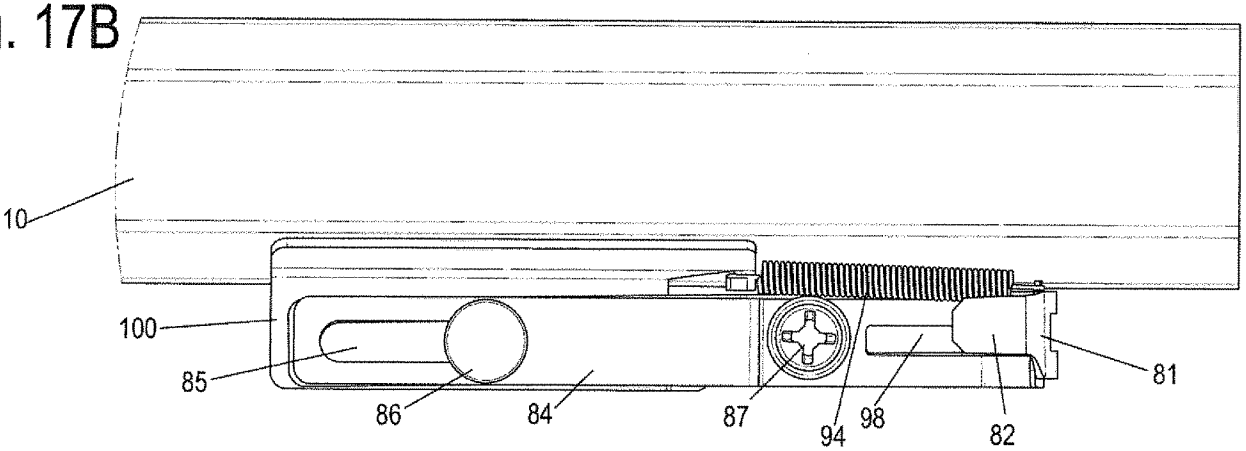
Figure 18A:
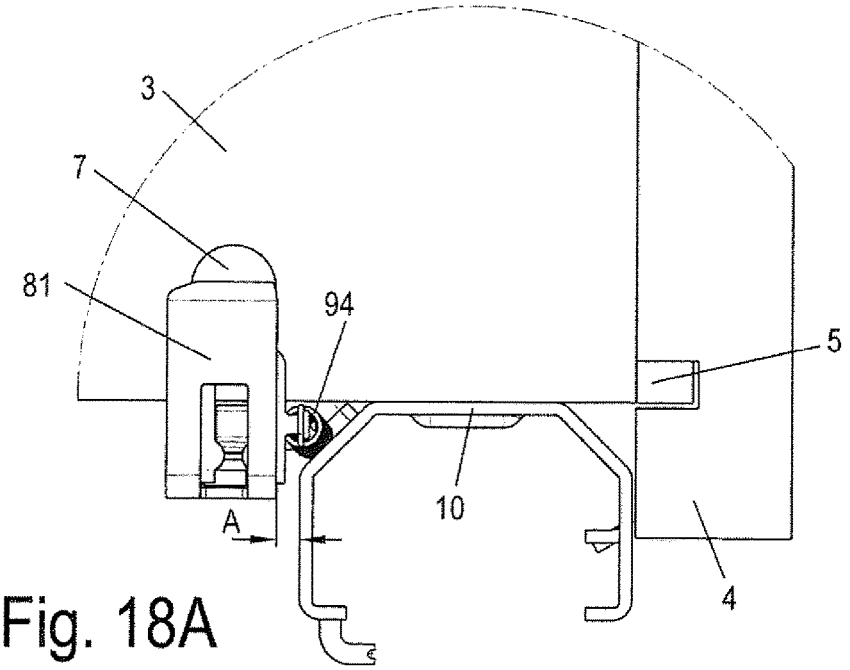
Figure 18B:
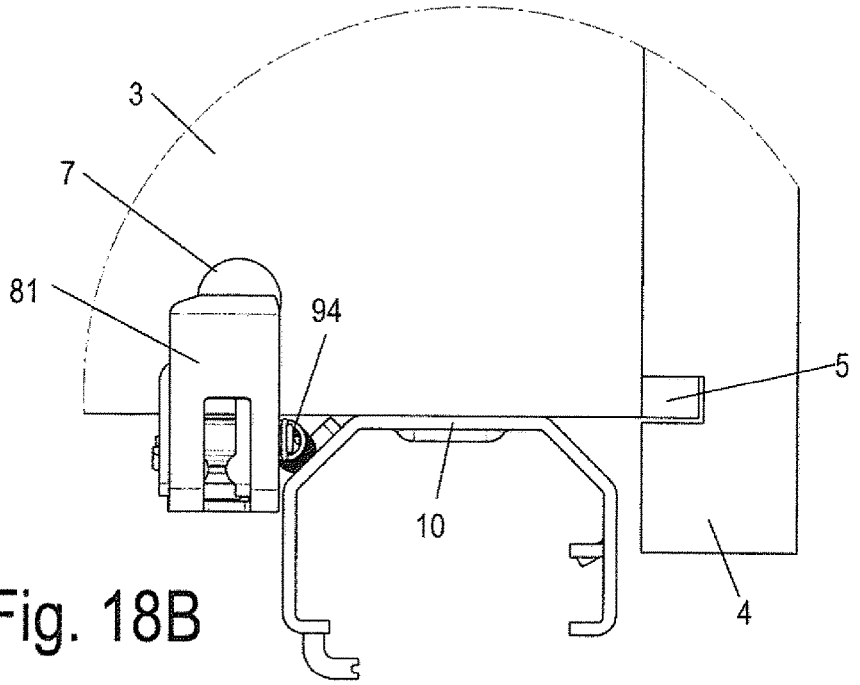

The lateral adjustment is shown in a top view in FIGS. 17A and 17B and in a rear view in FIGS. 18A and 18B. The holder 81 is arranged with a gap A in relation to the slide rail 10 in FIGS. 17A and 18A. By rotating the eccentric 87, the holder 81 pivots about the bolt 86 and the holder 81 with the lower web 83 is pivoted toward the slide rail 10, as shown in FIGS. 17B and 18B. A corresponding alignment of the drawer 1 in relation to the slide rail 10 can thus be performed.

Figure 19A:
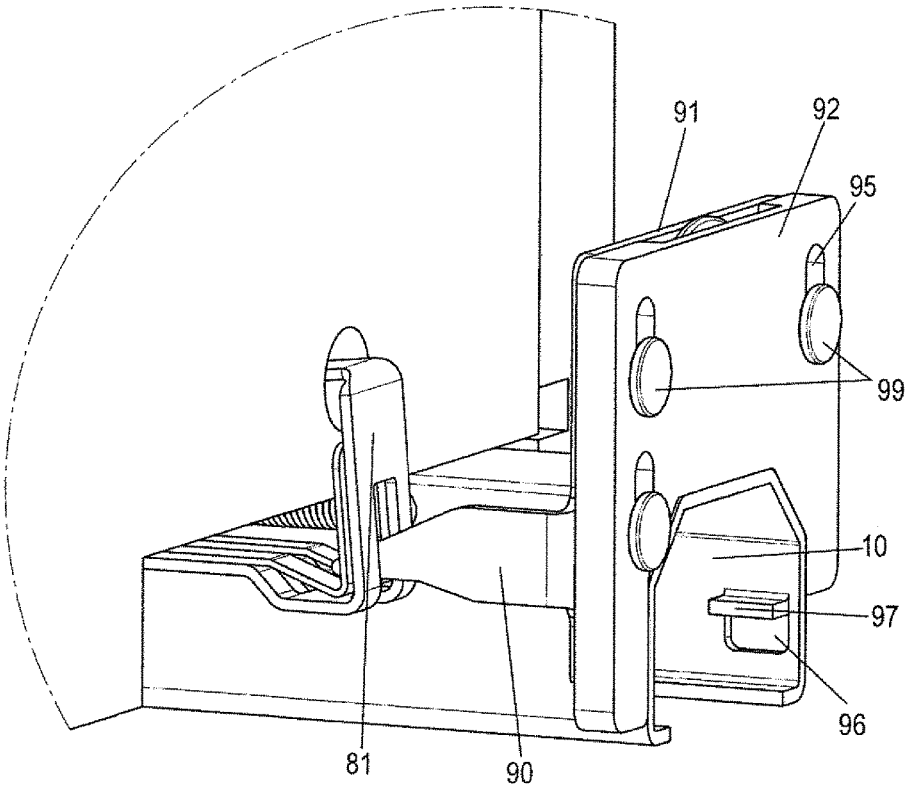
Figure 19B:
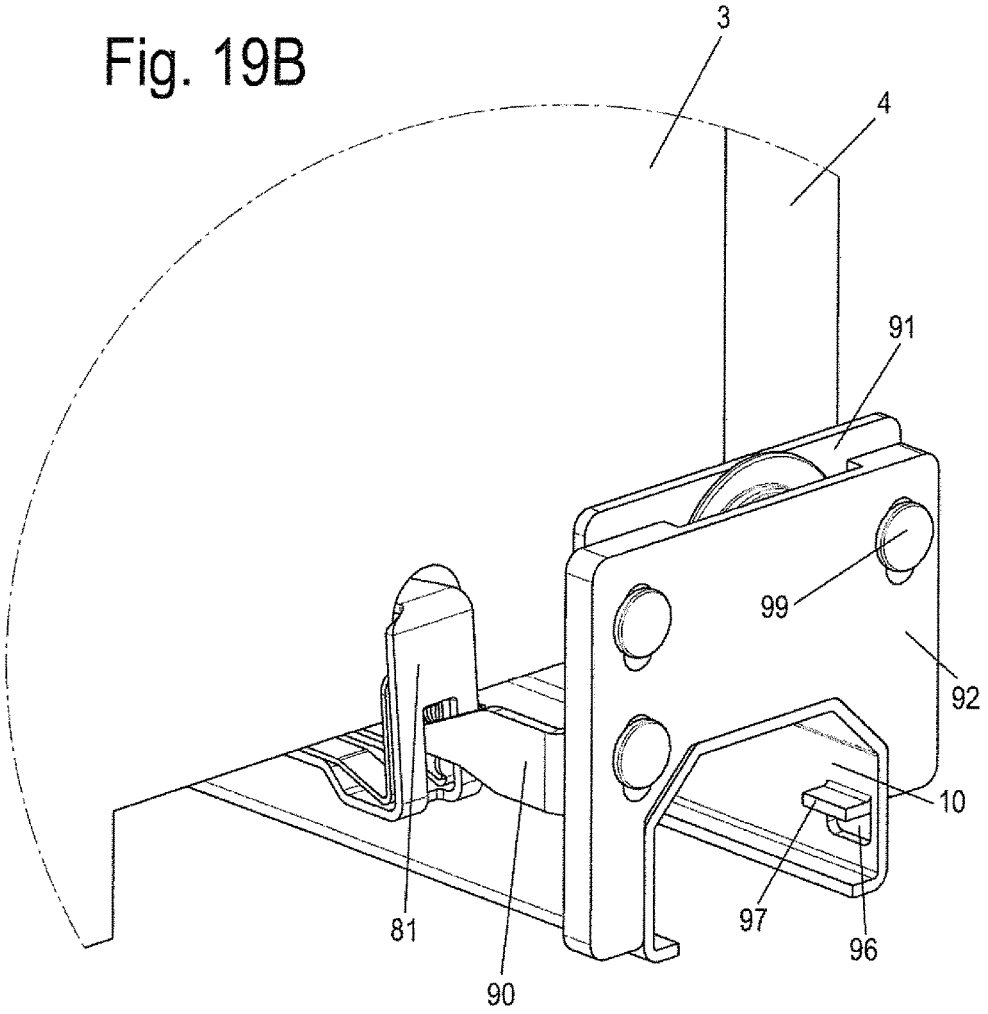

The vertical adjustment of the securing device 80 is shown in FIGS. 19A and 19B. By rotating the eccentric 93, the plate 91 is vertically adjusted in relation to the support plate 92, wherein the lowered position is shown in FIG. 19A and the raised position is shown in FIG. 19B. By moving the vertical plate 91 in relation to the support plate 92, the lug 90 is accordingly raised or lowered.

Figure 20A:
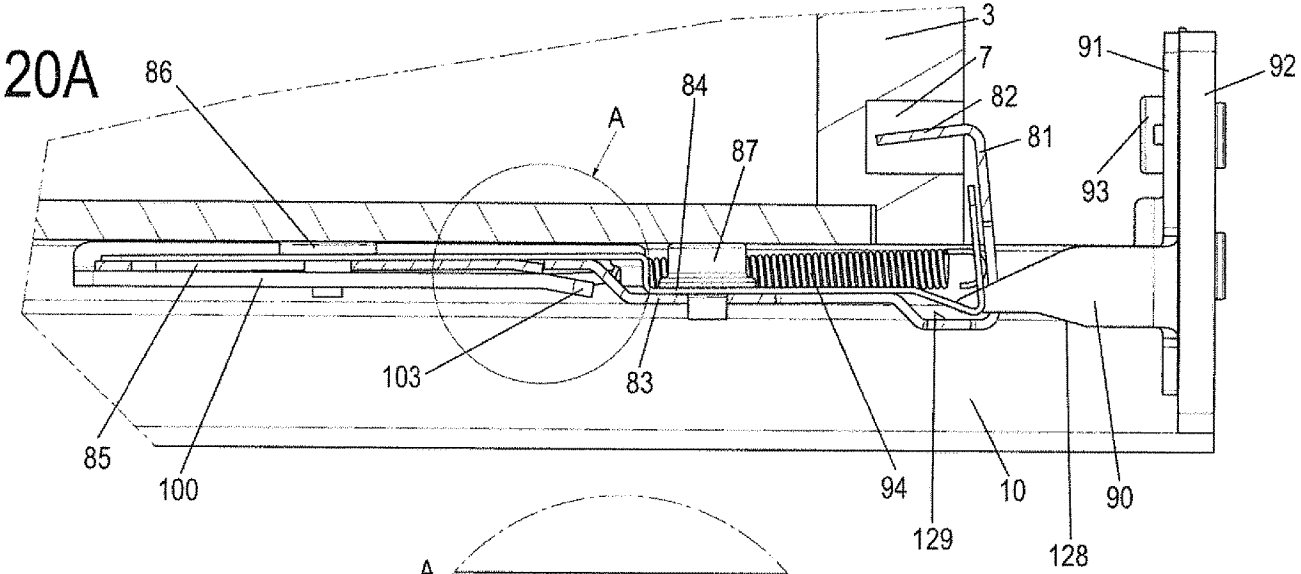
Figure 20B:
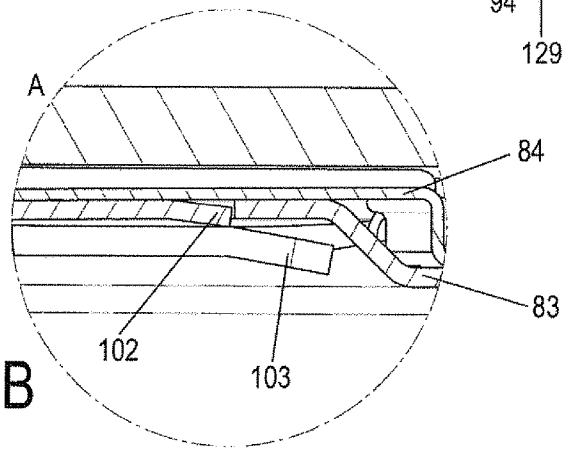

FIGS. 20A and 20B show the situation in which the holder 81 presses in a pre-tensioned manner against its front stop and the drawer was already pushed onto the projection 82 by means of its opening 7. For this purpose, a section through the securing device 80 is shown, in which the arrangement of the eccentric 87 in the region of the lower web 83 and the upper web 84 is recognizable. In addition, it is shown in FIG. 20B that the holding web 100 has a portion 103 angled diagonally downward toward the rear side, which is inclined in relation to the horizontal in an angle range between 2° and 20°, in particular 5° to 10°, and forms an inclined plane. Thus, in the event of a displacement of the lower web 83 in the horizontal pre-tensioning direction, the holder 81 can be raised. The lower web 83 has a downwardly oriented projection 102, which is raised during the displacement along the portion 103. By raising the holder 81, the projection 82 is raised into a vertical position approximately in the middle of the opening 7 of the drawer. Since the drawer bottom 5 rests flush on the slide rail 10, the optimum height of the projection 81 in the middle of the opening 7 is therefore uniquely determined, whereby the pushing of the drawer onto the projection 82 is simplified.

Figure 21A:
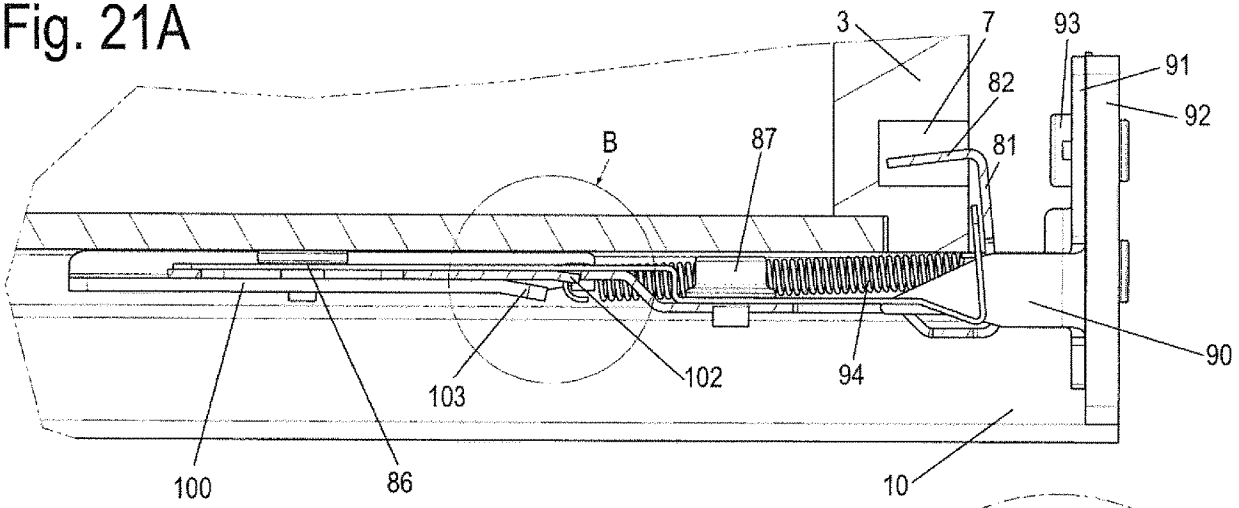
Figure 21B:
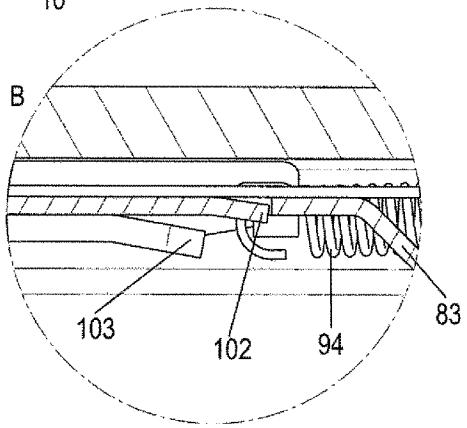

FIGS. 21A and 21B show an installation position in which the holder 81 was displaced to the rear by the drawer 1, however, not yet into the final position. The downwardly protruding projection 102 thus moves downward via the inclined portion 103, so that the holder 81 is lowered into its normal location.

This lowering of the holder 81 during the installation can be used to fix the drawer 1 nearly without play or in a clamped manner on the slide rail. For this purpose, the lower web 83 or the holder 81 can be produced from spring steel in particular. Nearly play-free or clamping fixation of the drawer on the slide rail 10 is also achieved in that as the drawer is pushed to the rear, the lower web 83 strikes with a control surface 129 on a control curve 128 on the lug 90, and the drawer together with the lower web 83 is pushed further to the rear. The control surface 129 runs downward to the rear in this case along the inclined control curve 128, whereby the rear end of the holder is lowered downward. The projection 82 draws the drawer bottom toward the upper edge of the lug 90 in this case.

The lower web 83 can be manufactured in this case from spring steel, this enables a tolerance compensation due to the elasticity during the clamping (vertically) in conjunction with the push to the rear of the drawer.

The adjustment mechanisms shown in the illustrated exemplary embodiments, via oblong holes, pins, and eccentrics, can be modified by a person skilled in the art, of course. Instead of an eccentric adjustment, a curve guide, a worm gear, or another component can be provided to perform a corresponding adjustment. In addition, the linear guides via oblong holes can naturally also be replaced by grooves and slides.

The mechanism for fixing the holder 81 on the rear wall 3 of the drawer can also be varied, wherein the holder 81 is preferably moved diagonally downward during the installation of the drawer 3, to fix the drawer 1 in a clamped manner on the slide rail 10.

For the installation on a furniture body having two pullout guides on the side walls, firstly a drawer is placed on the slide rails and pushed in the direction of the rear wall. In this case, the drawer moves on the holder and therefore couples the drawer to the slide rail so it is displaceable in the longitudinal direction. Drawer and holder are then displaced in the coupled position jointly up to the installation end position.

Before the displacement or during the displacement, the drawer can change its vertical position and move the holder with it.

Furthermore, in the further course of the displacement up to the end position, the holder can move in its guide diagonally in relation to the longitudinal direction and clamp the drawer on the slide rail at the same time.

The invention claimed is:

1. A pullout guide for a drawer having a guide rail fixable on a body and a movably mounted slide rail, wherein at least one middle rail can optionally be provided between the guide rail and the slide rail, and a securing device having a holder is provided on the slide rail, on which a drawer is fixable, wherein the holder is mounted so it is displaceable with respect to the slide rail against the spring action of a force accumulator in the longitudinal direction of the slide rail, and wherein the displaceable holder has an upper projection, which is insertable into an opening or a holding device on a rear wall of the drawer.

2. The pullout guide according to claim 1, wherein an essentially linear guide is provided for the holder.

3. The pullout guide according to claim 2, wherein the guide is arranged laterally on the slide rail.

4. The pullout guide according to claim 1, wherein the displaceable holder has a lower guide portion, which is movable along a guide.

5. The pullout guide according to claim 1, wherein the force accumulator applies a force forward in the extension direction to the displaceable holder.

6. The pullout guide according to claim 1, wherein the drawer is fixed via the holder and further securing means on the slide rail.

7. The pullout guide according to claim 1, wherein a spring is tensioned between the movable holder and an immovable part of the securing device or the slide rail.

8. The pullout guide according to claim 1, wherein the holder is adjustable in a horizontal direction perpendicular to the longitudinal direction of the slide rail.

9. The pullout guide according to claim 1, wherein the guide is mounted with the holder so it is pivotable on a housing of the securing device or directly on the slide rail.

10. The pullout guide according to claim 1, wherein the securing device comprises a vertical adjustment unit for the drawer.

11. The pullout guide according to claim 10, wherein the vertical adjustment unit has a slide guided diagonally in relation to the horizontal or an eccentric or a threaded spindle.

12. The pullout guide according to claim 1, wherein the holder is vertically adjustable via an adjustment element.

13. The pullout guide according to claim 1, wherein the drawer is vertically adjustable in relation to the slide rail via at least one of a slide on the securing device and a holding device on the rear wall-of the drawer.

14. The pullout guide according to claim 1, wherein for vertical adjustment, the holder engages with the projection between support elements, which are arranged on the rear side of the drawer in a holding device, wherein the holding device is mounted so it is vertically movable in relation to the slide rail.

15. The pullout guide according to claim 1, wherein the holder is displaceable along a guide, which is aligned inclined in relation to the horizontal.

16. The pullout guide according to claim 15, wherein the guide slopes downward to the rear and the drawer thus is fixed in a clamping manner on the slide rail during the displacement of the holder or the drawer presses nearly without play against the slide rail.

17. The pullout guide according to claim 1, wherein the displaceable travel of the holder is delimited by stops.

18. The pullout guide according to claim 1, wherein the distance between the rear wall or a holding device on the rear wall and the holder remains substantially unchanged during the drawer installation from the coupling of the holder to the drawer until reaching the installation end position of the drawer.

19. The pullout guide according to claim 4, wherein the projection plunges with at least 80% of its length into at least one of the drawer and into a holding device on the rear wall of the drawer.

20. The pullout guide according to claim 1, wherein the drawer or the pullout guide comprises a depth adjustment, which comprises a relative movement between the drawer and the slide rail.

21. A piece of furniture or a domestic appliance having at least two pullout guides according to claim 1, on which a drawer is fixed.

* * * * *